US007458660B2

(12) United States Patent
Yoshida

(10) Patent No.: US 7,458,660 B2
(45) Date of Patent: Dec. 2, 2008

(54) RECORDING APPARATUS, RECORDING METHOD, STORAGE MEDIUM HAVING A PROGRAM STORED THEREON, AND COMPUTER SYSTEM THAT PERFORM EJECTION OPERATIONS USING NOZZLES WITH A PREDETERMINED PITCH

(75) Inventor: Masahiko Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 391 days.

(21) Appl. No.: 10/531,063

(22) PCT Filed: Feb. 27, 2004

(86) PCT No.: PCT/JP2004/002418

§ 371 (c)(1),
(2), (4) Date: Apr. 12, 2005

(87) PCT Pub. No.: WO2004/080719

PCT Pub. Date: Sep. 23, 2004

(65) Prior Publication Data

US 2006/0012621 A1 Jan. 19, 2006

(30) Foreign Application Priority Data

Mar. 14, 2003 (JP) ..... 2003-070657

(51) Int. Cl.
*B41J 2/14* (2006.01)
*B41J 2/16* (2006.01)

(52) U.S. Cl. ..... 347/47; 347/20

(58) Field of Classification Search ..... 347/20, 347/44, 47, 12, 40, 41, 42
See application file for complete search history.

(56) References Cited

U.S. PATENT DOCUMENTS 6,302,517 B1 * 10/2001 Kanaya ..... 347/41

FOREIGN PATENT DOCUMENTS

| | | | |
|---|---|---|---|
| EP | 0 076 948 | A2 | 4/1983 |
| JP | 8-127138 | A | 5/1996 |
| JP | 10-323978 | A | 12/1998 |
| JP | 2000-238300 | A | 9/2000 |
| JP | 2001-113691 | A | 4/2001 |
| JP | 2001-138577 | A | 5/2001 |

* cited by examiner

*Primary Examiner*—Juanita D Stephens
(74) *Attorney, Agent, or Firm*—Sughrue Mion, PLLC

(57) ABSTRACT

A recording apparatus of the present invention includes a head 21 having a plurality of nozzle groups (21A to 21C), and each nozzle group has a plurality of nozzles that are arranged with a predetermined nozzle pitch (k·D). The recording apparatus forms dots on a medium by repeating alternately an ejection operation in which a liquid is ejected from the nozzles and a carry operation in which the medium is carried using a predetermined carry amount F with respect to the head, and the distance between two nozzles that eject ink adjacently and that belong to different nozzle groups (the distance between #4A and #1B) is equal to the sum of an integral multiple of the carry amount and the predetermined nozzle pitch (F·α+k·D).

18 Claims, 22 Drawing Sheets

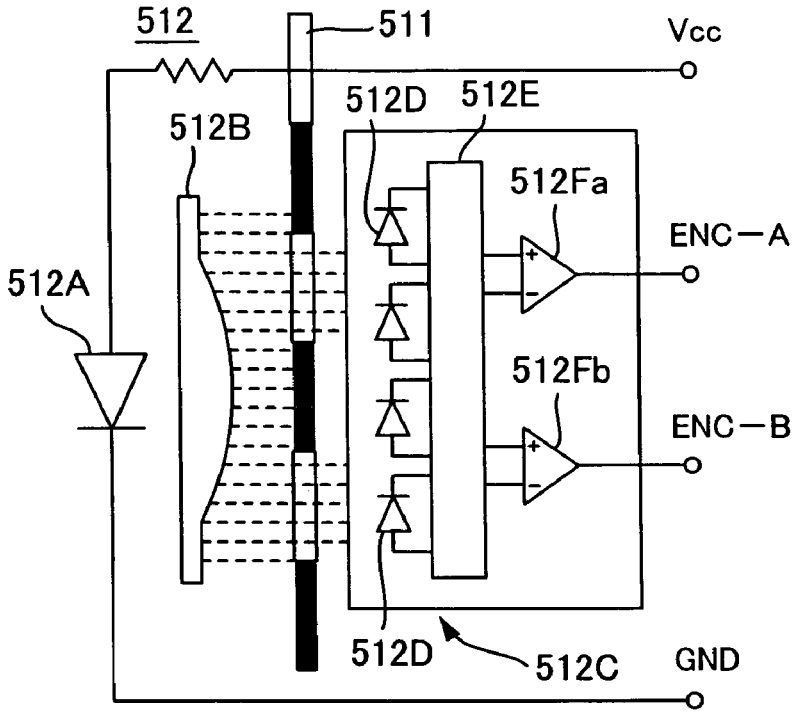
FIG. 5
FIG. 6A
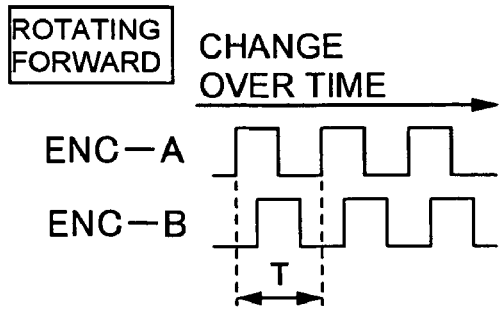
FIG. 6B
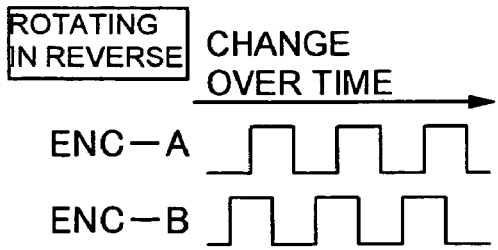

RECORDING APPARATUS, RECORDING METHOD, STORAGE MEDIUM HAVING A PROGRAM STORED THEREON, AND COMPUTER SYSTEM THAT PERFORM EJECTION OPERATIONS USING NOZZLES WITH A PREDETERMINED PITCH

TECHNICAL FIELD

The present invention relates to printing apparatuses and printing methods for printing onto a medium to be printed, such as paper. The present invention also relates to storage media storing a program for controlling such printing apparatuses and computer systems.

The present application claims priority upon Japanese Patent Application No. 2003-070657 filed on Mar. 14, 2003, which is herein incorporated by reference.

BACKGROUND ART

Inkjet printers that perform printing by intermittently ejecting ink are known as recording apparatuses for recording images onto various types of media (media to be printed), including paper, cloth, and film. In such inkjet printers, an operation in which a medium is carried in the paper carrying direction (also referred to as "sub-scanning direction") and an operation in which ink is ejected from nozzles that are moved in the scanning direction (also referred to as "movement direction" or "main-scanning direction") are repeated alternately to form dots on the medium.

It is desirable for such inkjet printers to have a large number of nozzles so that the recording speed is increased. However, simply increasing the number-of nozzles makes it difficult to produce a head. Thus, it has been proposed that the number of nozzles is increased using a configuration in which a plurality of nozzle groups are provided in a head (for example, Japanese Laid-Open Patent Publication No. H10-323978).

When a plurality of nozzle groups are provided in a head, it is desirable that there is flexibility in the setting of the spacing of the nozzle groups. Moreover, it is preferable that the same head can be adopted for a plurality of recording modes.

Therefore, it is an object of the present invention to increase design flexibility when a plurality of nozzle groups are provided in a head.

DISCLOSURE OF INVENTION

The main aspect of the invention for achieving the foregoing object is a recording apparatus for forming dots on a medium, comprising: a head having a plurality of nozzle groups, each of the nozzle groups having a plurality of nozzles that are arranged with a predetermined nozzle pitch; wherein the recording apparatus forms the dots on the medium by repeating alternately an ejection operation in which a liquid is ejected from the nozzles and a carry operation in which the medium is carried using a predetermined carry amount with respect to the head; and wherein a distance between two nozzles that eject the liquid adjacently and that belong to different ones of the nozzle groups is equal to a sum of an integral multiple of the carry amount and the predetermined nozzle pitch.

The present invention has other aspects. Other features of the present invention will become clear through the accompanying drawings and the description of the present specification.

BRIEF DESCRIPTION OF THE DRAWINGS

FIG. 5 is an explanatory diagram of a configuration of a linear encoder.

FIG. 6A is a timing chart of waveforms of output signals when a CR motor 42 is rotating forward, and FIG. 6B is a timing chart of the waveforms of the output signals when the CR motor 42 is rotating in reverse.

<Regarding Reference Numerals>

Figure 1:
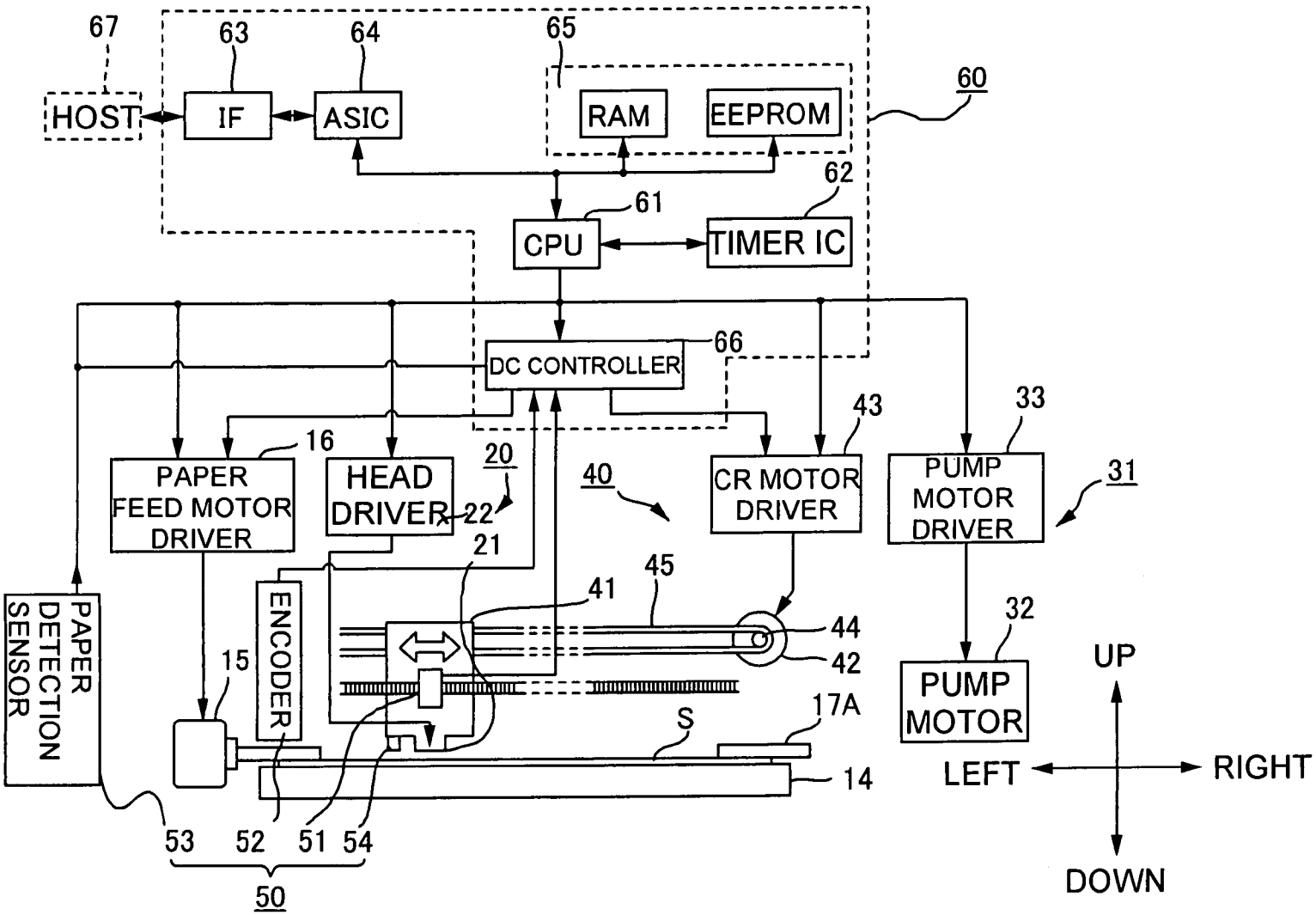
FIG. 1 is an explanatory diagram of an overall configuration of an inkjet printer.

10 paper carrying unit, 11A paper insert opening, 11B roll paper insert opening, 13 paper supply roller, 14 platen, 15 paper feed motor (PF motor), 16 paper feed motor driver (PF motor driver), 17A paper feed roller, 17B paper discharge rollers, and 18A and 18B free rollers.

20 ink ejection unit, 21 head (21A to 21C, nozzle groups A to C), and 22 head driver.

30 cleaning unit, 31 pump device, 32 pump motor, 33 pump motor driver, and 35 capping device.

40 carriage unit, 41 carriage, 42 carriage motor (CR motor), 43 carriage motor driver (CR motor driver), 44 pulley, 45 timing belt, and 46 guide rail.

50 measuring instrument group, 51 linear encoder, 511 linear scale, 512 detection section, 52 rotary encoder, 53 paper detection sensor, and 54 paper width sensor.

60 control unit, 61 CPU, 62 timer, 63 interface section, 64 ASIC, 65 memory, 66 DC controller, and 67 host computer.

BEST MODE FOR CARRYING OUT THE INVENTION

===Overview of the Disclosure===

At least the following matters will be made clear by the present specification and the description of the accompanying drawings.

A recording apparatus for forming dots on a medium, comprises:

a head having a plurality of nozzle groups, each of the nozzle groups having a plurality of nozzles that are arranged with a predetermined nozzle pitch;

wherein the recording apparatus forms the dots on the medium by repeating alternately an ejection operation in which a liquid is ejected from the nozzles and a carry operation in which the medium is carried using a predetermined carry amount with respect to the head; and wherein a distance between two nozzles that eject the liquid adjacently and that belong to different ones of the nozzle groups is equal to a sum of an integral multiple of the carry amount and the predetermined nozzle pitch.

According to this recording apparatus, design flexibility can be increased when a plurality of nozzle groups are provided in the head.

In the recording apparatus, it is desirable that there is a nozzle between the two nozzles that does not eject the liquid. According to this recording apparatus, the distance between the two nozzles can be set as appropriate without changing the configuration of the head.

In the recording apparatus, it is desirable that a nozzle at one end of the plurality of nozzles that are arranged does not eject the liquid. According to this recording apparatus, recording can be performed such that the condition of the distance between the two nozzles is satisfied without changing the configuration of the head. Moreover, according to this recording apparatus, the number of nozzles that eject the liquid is not limited to the number of nozzles contained in the head. Therefore, the recording apparatus can be adopted even for a recording mode in which the carry amount is set in accordance with the number of nozzles that eject the liquid, without changing the configuration of the head.

In the recording apparatus, it is desirable that the recording apparatus is capable of performing recording using different recording modes. This recording apparatus offers a high level of design flexibility of the head, so that it is possible to use the same head to perform recording using different recording modes. Moreover, it is preferable that the nozzles that eject the liquid differ for different ones of the recording modes. According to this recording apparatus, the distance between the two nozzles can be set as appropriate according to the recording mode. Moreover, it is preferable that a spacing of the dots formed on the medium differs for different ones of the recording modes. Since the carry amount varies with the spacing of dots, the distance between the two nozzles has to be matched with that carry amount. However, according to this recording apparatus, the distance between the two nozzles can be set as appropriate according to the carry amount, so that different dot spacings can be formed using the same head. Furthermore, it is preferable that a number of the nozzles that form a single raster line differs for different ones of the recording modes. Since the carry amount varies with the number of nozzles that form a single raster line, the distance between the two nozzles has to be matched with that carry amount. However, according to this recording apparatus, the distance between the two nozzles can be set as appropriate according to the carry amount, so that different dot spacings can be formed using the same head. Furthermore, it is advantageous that the distance between the two nozzles is equal to a sum of an even multiple of the carry amount and the nozzle pitch. According to this recording apparatus, it is possible to provide a head that can be used for a plurality of print modes.

In the recording apparatus, it is desirable that the head includes three or more of the nozzle groups; and a number of the nozzles that eject the liquid is equal between at least two of the nozzle groups. Moreover, it is preferable that the two-nozzle groups are provided adjacent to each other in a direction in which the medium is carried. According to this recording apparatus, all of the distances between the two nozzles can be set to be equal.

In the recording apparatus, it is desirable that when a spacing of the dots formed on the medium is D, the nozzle pitch is $k \cdot D$, a number of the nozzles that are allowed to eject the liquid is N, and the carry amount is F, then N and k are coprime, and $F=N \cdot D$. According to this recording apparatus, it is possible to perform interlaced printing using the head provided with a plurality of nozzle groups.

In the recording apparatus, it is desirable that when a single raster line is formed by M nozzles, and when a spacing of the dots formed on the medium is D, the nozzle pitch is $k \cdot D$, a number of the nozzles that are allowed to eject the liquid is N, and the carry amount is F, then N/M is an integer, N/M and k are coprime, and $F=(N/M) \cdot D$. According to this recording apparatus, it is possible to perform overlap printing using the head provided with a plurality of nozzle groups. Moreover, it is preferable that the distance between the two nozzles is equal to a sum of an integral multiple of a value obtained by multiplying the carry amount by M and the predetermined nozzle pitch. According to this recording apparatus, it is possible to perform recording using a mode other than overlap printing without changing the configuration of the head.

A recording method using a head having a plurality of nozzle groups, each of which has a plurality of nozzles that are arranged with a predetermined nozzle pitch, is also possible. An ejection operation in which a liquid is ejected from the nozzles and a carry operation in which a medium is carried using a predetermined carry amount with respect to the head are repeated alternately to form dots on the medium, and the ejection operation is performed such that a distance between two nozzles that eject the liquid adjacently and that belong to different nozzle groups is equal to a sum of an integral multiple of the carry amount and the predetermined nozzle pitch.

A storage medium for storing a program for controlling a recording apparatus is also possible. The storage medium includes a storage medium for storing the program, and the recording apparatus includes a head having a plurality of nozzle groups, and each of the nozzle groups has a plurality of nozzles that are arranged with a predetermined nozzle pitch, and the program makes: (1) the recording apparatus form dots on a medium by repeating alternately an ejection operation in which a liquid is ejected from the nozzles and a carry operation in which the medium is carried using a predetermined carry amount with respect to the head; and (2) the recording apparatus perform the ejection operation such that a distance between two nozzles that eject the liquid adjacently and that belong to different nozzle groups is equal to a sum of an integral multiple of the carry amount and the predetermined nozzle pitch.

A computer system including a main computer unit and a recording apparatus is also possible. The recording apparatus includes a head having a plurality of nozzle groups, each nozzle group having a plurality of nozzles that are arranged with a predetermined nozzle pitch, and forms dots on a medium by repeating alternately an ejection operation in which a liquid is ejected from the nozzles and a carry operation in which the medium is carried using a predetermined carry amount with respect to the head, and a distance between two nozzles that eject the liquid adjacently and that belong to different nozzle groups is equal to a sum of an integral multiple of the carry amount and the predetermined nozzle pitch.

===Overview of Printing Apparatus (Inkjet Printer)===

<Regarding a Configuration of the Inkjet Printer>

Figure 2:
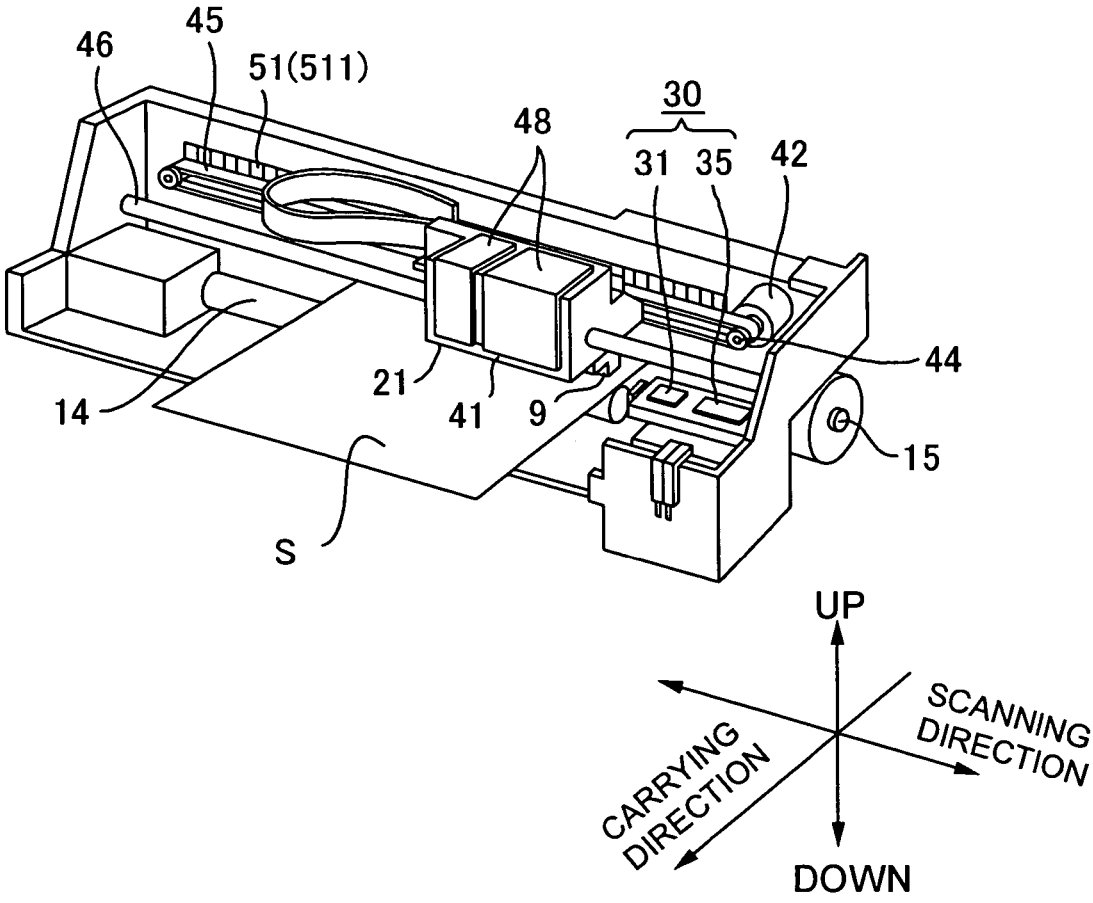
FIG. 2 is a schematic diagram of a carriage area of the inkjet printer.
Figure 3:
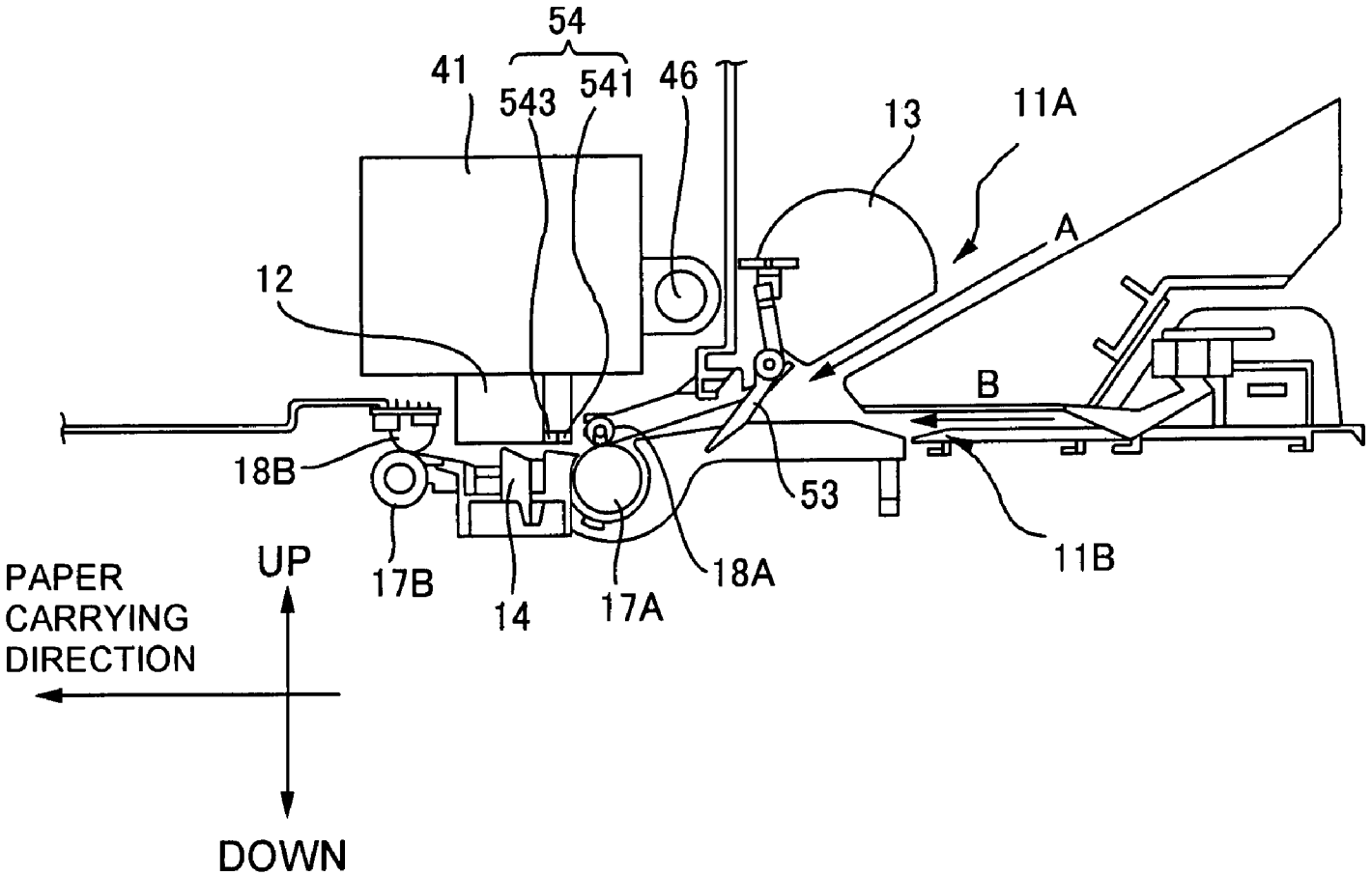
FIG. 3 is an explanatory diagram of a carrying unit area of the inkjet printer.
Figure 4:
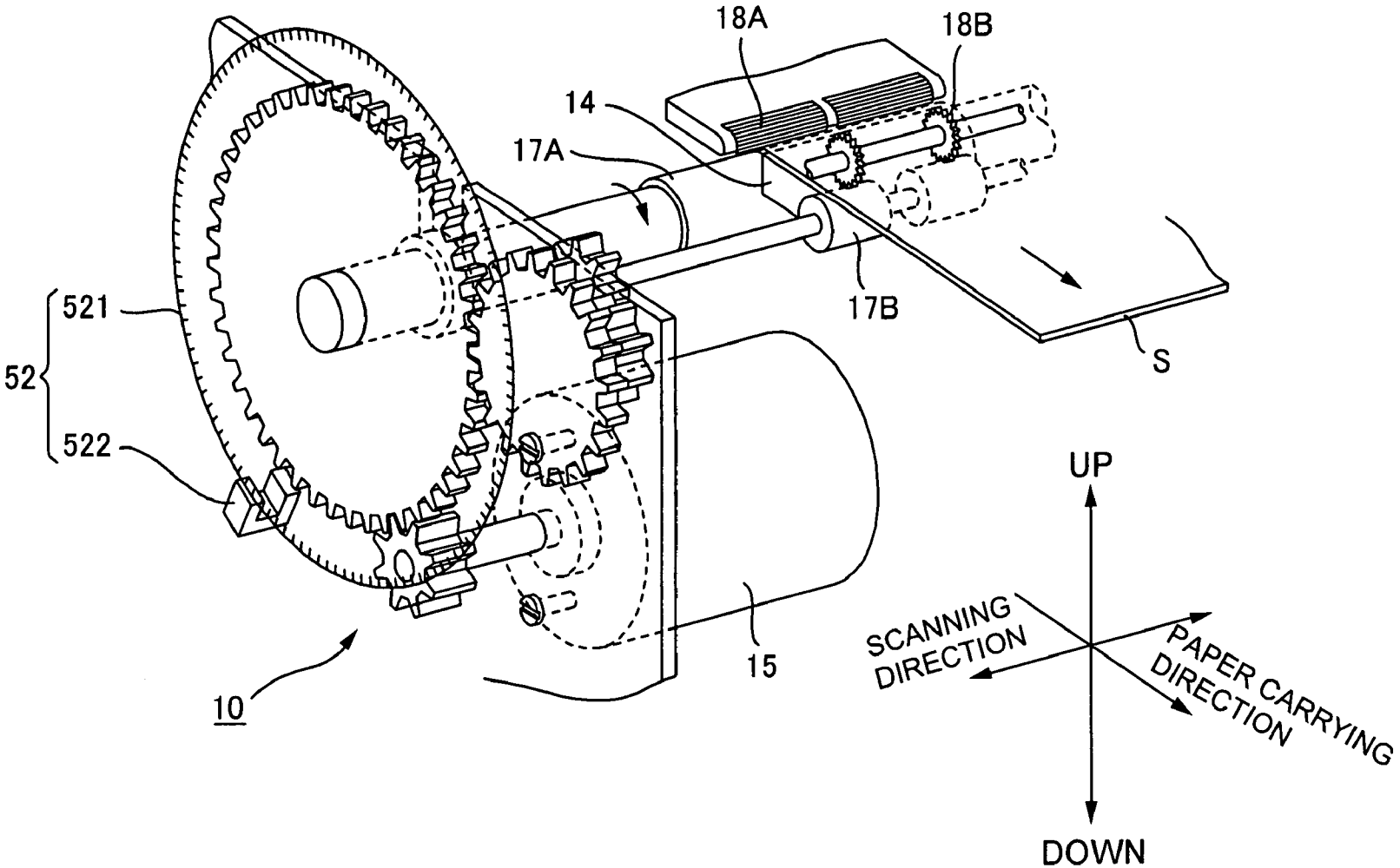
FIG. 4 is a perspective view of the carrying unit area of the inkjet printer.

An overview of an inkjet printer serving as an example of a printing apparatus is described with reference to FIGS. 1, 2, 3, and 4. FIG. 1 is an explanatory diagram of an overall configuration of an inkjet printer of this embodiment. FIG. 2 is a schematic diagram of a carriage area of the inkjet printer of this embodiment. FIG. 3 is an explanatory diagram of a carrying unit area of the inkjet printer of this embodiment. FIG. 4 is a perspective view of the carrying unit area of the inkjet printer of this embodiment.

The inkjet printer of this embodiment has a paper carrying unit 10, an ink ejection unit 20, a cleaning unit 30, a carriage unit 40, a measuring instrument group 50, and a control unit 60.

The paper carrying unit 10 is for feeding paper, which is an example of a medium to be printed, into a printable position and making the paper move in a predetermined direction (the direction perpendicular to the paper face in FIG. 1 (hereinafter, referred to as the "paper carrying direction")) by a predetermined shift amount during printing. In other words, the paper carrying unit 10 functions as a carrying mechanism for carrying paper. The paper carrying unit 10 has a paper insert opening 11A and a roll paper insert opening 11B, a paper supply motor (not shown), a paper supply roller 13, a platen 14, a paper feed motor (hereinafter, referred to as "PF motor") 15, a paper feed motor driver (hereinafter, referred to as "PF motor driver") 16, a paper feed roller 17A and paper discharge rollers 17B, and free rollers 18A and free rollers 18B. However, the paper carrying unit 10 does not necessarily have to include all of these components in order to function as a carrying mechanism.

The paper insert opening 11A is where paper, which is a medium to be printed, is inserted. The roll paper insert opening 11B is where roll paper is inserted. The paper supply motor (not shown) is a motor for carrying the paper that has been inserted into the paper insert opening 11A into the printer, and is constituted by a pulse motor. The paper supply roller 13 is a roller for automatically carrying the paper that has been inserted into the paper insert opening 11 into the printer, and is driven by the paper supply motor 12. The paper supply roller 13 has a transverse cross-sectional shape that is substantially the shape of the letter D. The peripheral length of a circumference section of the paper supply roller 13 is set longer than the carrying distance to the PF motor 15, so that using this circumference section the medium to be printed can be carried up to the PF motor 15. It should be noted that a plurality of media to be printed are kept from being supplied at one time by the rotational drive force of the paper supply roller 13 and the friction resistance of separating pads (not shown). The sequence through which the medium to be printed is carried is described in detail later.

The platen 14 supports the paper S during printing. The PF motor 15 is a motor for feeding paper, which is an example of a medium to be printed, in the paper carrying direction, and is constituted by a DC motor. The PF motor driver 16 is for driving the PF motor 15. The paper feed roller 17A is a roller for feeding the paper S that has been carried into the printer by the paper supply roller 13 to a printable region, and is driven by the PF motor 15. The free rollers 18A are provided in a position that is in opposition to the paper feed roller 17A, and push the paper S toward the paper feed roller 17A by sandwiching the paper S between them and the paper feed roller 17A.

The paper discharge rollers 17B are rollers for discharging the paper S for which printing has finished to outside the printer. The paper discharge rollers 17B are driven by the PF motor 15 through a gear that is not shown in the drawings. The free rollers 18B are provided in a position that is in opposition to the paper discharge rollers 17B, and push the paper S toward the paper discharge rollers 17B by sandwiching the paper S between them and the paper discharge rollers 17B.

The ink ejection unit 20 is for ejecting ink onto paper, which is an example of a medium to be printed. The ink ejection unit 20 has a head 21 and a head driver 22. The head 21 has a plurality of nozzles from which ink is ejected, and ejects ink intermittently from each of the nozzles. The head driver 22 is for driving the head 21 so that ink is ejected intermittently from the head.

The cleaning unit 30 is for preventing the nozzles of the head 21 from becoming clogged. The cleaning unit 30 has a pump device 31 and a capping device 35. The pump device is for extracting ink from the nozzles in order to prevent the nozzles of the head 21 from becoming clogged, and has a pump motor 32 and a pump motor driver 33. The pump motor 32 sucks out ink from the nozzles of the head 21. The pump motor driver 33 drives the pump motor 32. The capping device 35 is for sealing the nozzles of the head 21 when printing is not being performed (during standby) so that the nozzles of the head 21 are kept from becoming clogged.

The carriage unit 40 is for making the head 21 scan and move in a predetermined direction (the left to right direction of the paper face in FIG. 1 (hereinafter, this is referred to as "scanning direction")). The carriage unit 40 has a carriage 41, a carriage motor (hereinafter, referred to as "CR motor") 42, a carriage motor driver (hereinafter, referred to as "CR motor driver") 43, a pulley 44, a timing belt 45, and a guide rail 46. The carriage 41 can be moved in the scanning direction, and the head 21 is fastened to it (thus, the nozzles of the head 21 intermittently eject ink as they are being moved in the scanning direction). Moreover, the carriage 41 removably holds an ink cartridge 48 that accommodates ink. The CR motor 42 is a motor for moving the carriage in the scanning direction, and is constituted by a DC motor. The CR motor driver 43 is for driving the CR motor 42. The pulley 44 is attached to a rotation shaft of the CR motor 42. The timing belt 45 is driven by the pulley 44. The guide rail 46 is for guiding the carriage 41 in the scanning direction.

The measuring instrument group 50 includes a linear encoder 51, a rotary encoder 52, a paper detection sensor 53, and a paper width sensor 54. The linear encoder 51 is for detecting the position of the carriage 41. The rotary encoder 52 is for detecting the amount of rotation of the paper feed roller 17A. It should be noted that the configuration, for example, of the encoders is discussed later. The paper detection sensor 53 is for detecting the position of the front end of the paper to be printed. The paper detection sensor 53 is provided in a position where it can detect the position of the front end of the paper as the paper is being carried toward the paper feed roller 17A by the paper supply roller 13. It should be noted that the paper detection sensor 53 is a mechanical sensor that detects the front end of the paper through a mechanical mechanism. More specifically, the paper detection sensor 53 has a lever that can be rotated in the paper carrying direction, and this lever is disposed so that it protrudes into the path along which the paper is carried. In this way, the front end of the paper comes into contact with the lever and the lever is rotated, and thus the paper detection sensor 53 detects the position of the front end of the paper by detecting the movement of the lever. The paper width sensor 54 is attached to the carriage 41. The paper width sensor 54 is an optical sensor having a light emitting section 541 and a light receiving section 543, and detects whether the paper exists or not in the position of the paper width sensor 54 by detecting light that is reflected by the paper. The paper width sensor 54 detects the position of the edge of the paper while being moved by the carriage 41, so as to detect the width of the paper. The paper width sensor 54 can detect the front end of the paper by the position of the carriage 41. The paper width sensor 54 is an optical sensor, and thus detects positions with higher precision than the paper detection sensor 53.

The control unit 60 is for carrying out control of the printer. The control unit 60 has a CPU 61, a timer 62, an interface section 63, an ASIC 64, a memory 65, and a DC controller 66. The CPU 61 is for carrying out the overall control of the printer, and sends control commands to the DC controller 66, the PF motor driver 16, the CR motor driver 43, the pump motor driver 32, and the head driver 22. The timer 62 periodically generates interrupt signals with respect to the CPU 61. The interface section 63 exchanges data with a host computer 67 provided outside the printer. The ASIC 64 controls the printing resolution and the drive waveforms of the head, for example, based on printing information sent from the host computer 67 through the interface section 63. The memory 65 is for reserving an area for storing the programs for the ASIC 64 and the CPU 61 and a working area, for example, and has a storage section such as a RAM or an EEPROM. It should be noted that a program associated with printing operation that is discussed later is stored in the memory 65. The DC controller 66 controls the PF motor driver 16 and the CR motor driver 43 based on control commands sent from the CPU 61 and the output from the measuring instrument group 50.

<Regarding the Configuration of the Encoders>

FIG. 5 is an explanatory diagram of the linear encoder 51.

The linear encoder 51 is for detecting the position of the carriage 41, and has a linear scale 511 and a detection section 512.

The linear scale 511 has slits provided at a predetermined spacing (for example, every 1/180 inches (1 inch=2.54 cm)), and is fastened to the main printer unit.

The detection section 512 is provided in opposition to the linear scale 511, and is on the carriage 41 side. The detection section 512 has a light emitting diode 512A, a collimating lens 512B, and a detection processing section 512C. The detection processing section 512C is provided with a plurality of (for example, four) photodiodes 512D, a signal processing circuit 512E, and two comparators 512Fa and 512Fb.

The light emitting diode 512A emits light when a voltage Vcc is applied to it via resisters on both ends, and this light is incident on the collimating lens. The collimating lens 512B turns the light emitted from the light emitting diode 512A into parallel light, and irradiates the linear scale 511 with the parallel light. The parallel light that has passed through the slits provided in the linear scale passes through stationary slits (not shown) and is incident on the photodiodes 512D. The photodiodes 512D convert the incident light into electrical signals. The electrical signals output from the photodiodes are compared in the comparators 512Fa and 512Fb, and the comparison results are output in the form of pulses. The pulse ENC-A and the pulse ENC-B that are output from the comparators 512Fa and 512Fb are the output of the linear encoder 51.

FIG. 6A is a timing chart of waveforms of output signals when the CR motor 42 is rotating forward. FIG. 6B is a timing chart of the waveforms of the output signals when the CR motor 42 is rotating in reverse.

As shown in FIGS. 6A and 6B, the phases of the pulse ENC-A and the pulse ENC-B are misaligned by 90 degrees both when the CR motor 42 is rotating forward and when it is rotating in reverse. When the CR motor 42 is rotating forward, that is, when the carriage 41 is moving in the main-scanning direction, the phase of the pulse ENC-A leads the phase of the pulse ENC-B by 90 degrees, as shown in FIG. 6A. On the other hand, when the CR motor 42 is rotating in reverse, the phase of the pulse ENC-A is delayed by 90 degrees with respect to the phase of the pulse ENC-B, as shown in FIG. 6B. A single period T of the pulses is equal to the time during which the carriage 41 is moved by the spacing of the slits of the linear scale 511 (for example, by 1/180 inches (1 inch=2.54 cm)).

The position of the carriage 41 is detected as follows. First, the rising edge or the falling edge of either of the pulse ENC-A or ENC-B is detected, and the number of detected edges is counted. The position of the carriage 41 is calculated based on the counted number. With respect to the count number, when the CR motor 42 is rotating forward, a "+1" is added for each detected edge, and when the CR motor 42 is rotating in reverse, a "−1" is added for each detected edge. Since the period of the pulses ENC is equivalent to the slit spacing of the linear scale 511, when the counted number is multiplied by the slit spacing, the amount that the carriage 41 has moved from when the count number is "0" can be obtained. In other words, the resolution of the linear encoder 51 in this case is the slit spacing of the linear scale 511. It is also possible to detect the position of the carriage 41 using both of the pulse ENC-A and the pulse ENC-B. The periods of the pulse ENC-A and the pulse ENC-B are equivalent to the slit spacing of the linear scale 511, and the phases of the pulse ENC-A and the pulse ENC-B are misaligned by 90 degrees, so that if the rising edges and the falling edges of the pulses are detected and the number of detected edges is counted, then a counted number "1" corresponds to ¼ of the slit spacing of the linear scale 511. Therefore, if the counted number is multiplied by ¼ of the slit spacing, then the amount that the carriage 41 has moved from when the count number was "0" can be obtained. That is, the resolution of the linear encoder 51 in this case is ¼ of the slit spacing of the linear scale 511.

The velocity Vc of the carriage 41 is detected as follows. First, the rising edges or the falling edges of either the pulse ENC-A or ENC-B are detected. On the other hand, the time interval between edges of the pulses is counted with a timer counter. The period T (T=T1, T2, . . . ) is obtained from the counted value. Then, when the slit spacing of the linear scale 511 is λ, the velocity of the carriage can be found sequentially as λ/T. It is also possible to detect the velocity of the carriage 41 using both of the pulse ENC-A and the pulse ENC-B. By detecting the rising edges and the falling edges of the pulses, the time interval between edges, which corresponds to ¼ of the slit spacing of the linear scale 511, is counted with the timer counter. The period T (T=T1, T2, . . . ) is obtained from the counted value. Then, when the slit spacing of the linear scale 511 is λ, the velocity vc of the carriage can be found sequentially as Vc=λ/(4T).

The rotary encoder 52 has substantially the same configuration as the linear encoder 51, except that a rotation disk 521 that rotates in accordance with rotation of the paper feed roller 17A is used in place of the linear scale 511 that is provided on the main printer unit side, and that a detection section 522 that is provided on the main printer unit side is used in place of the detection section 512 that is provided on the carriage 41 (see FIG. 4).

It should be noted that the rotary encoder 52 directly detects the rotation amount of the paper feed roller 17A, and does not detect the carry amount of the paper. However, when the paper feed roller 17A is rotated to carry the paper, a carry error occurs due to slippage between the paper feed roller 17A and the paper. Therefore, the rotary encoder 52 cannot directly detect the carry error of the carry amount of the paper. Accordingly, a table that expresses the relationship between the rotation amount detected by the rotary encoder 52 and the carry error is created and stored in the memory 65 of the control unit 60. Then, the table is referenced based on the results detected by the rotary encoder, and the carry error is detected. This table is not limited to expressing the relationship between the rotation amount and the carry error, and also may be a table that expresses the relationship between the number of times of carries, for example, and the carry error. Moreover, because slippage varies depending on the characteristics of the paper, it is also possible to create a plurality of tables corresponding to the paper characteristics and to store these tables in the memory 65.

<Regarding the Configuration of the Nozzles>

Figure 7:
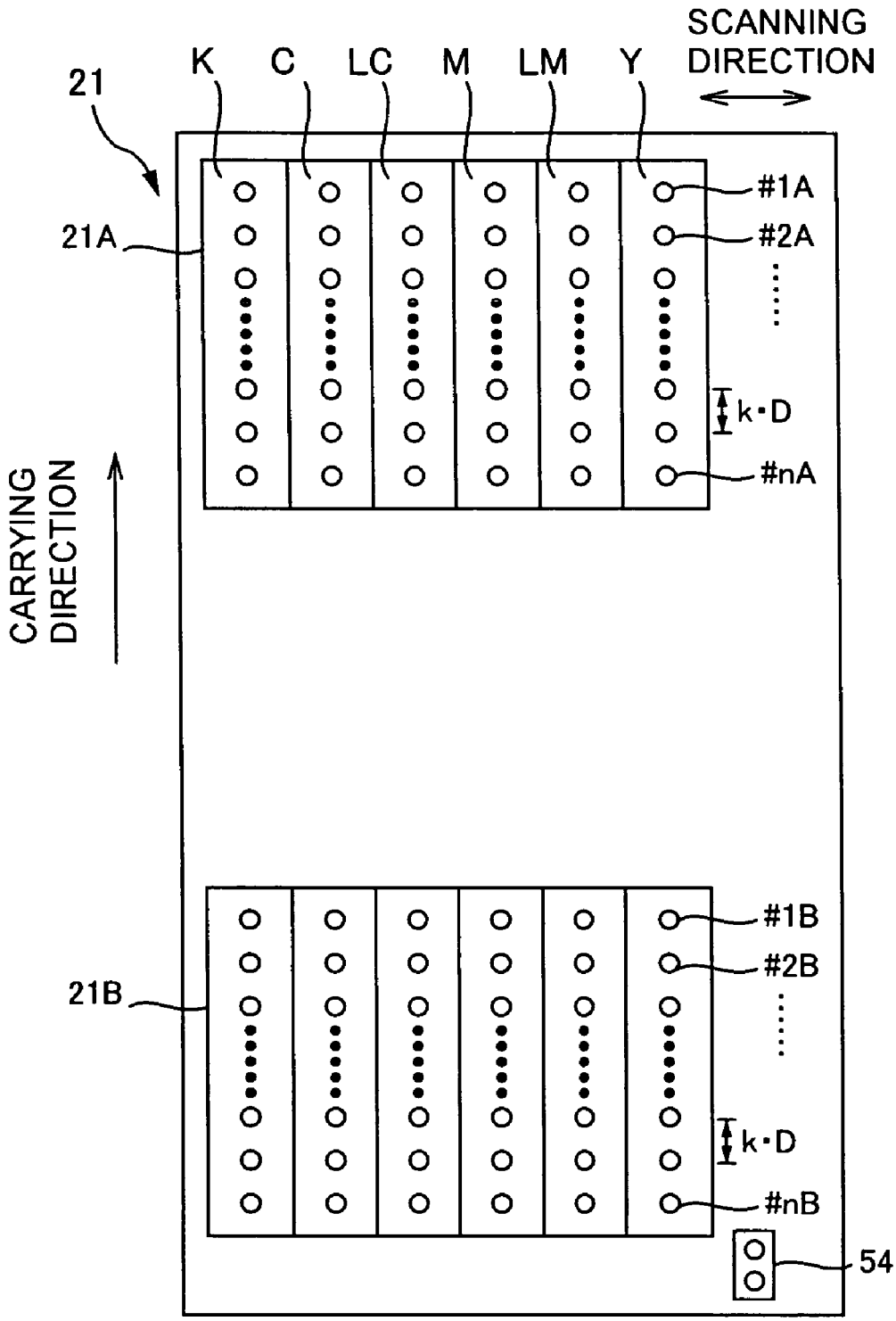
FIG. 7 is an explanatory diagram showing an arrangement of nozzle groups.

FIG. 7 is an explanatory diagram showing an arrangement of the nozzles. A plurality of nozzle groups (nozzle group 21A and nozzle group 21B) are provided on the lower surface of the head 21. Each nozzle group includes a dark black ink nozzle row KD, a light black ink nozzle row KL, a dark cyan ink nozzle row CD, a light cyan ink nozzle row CL, a dark magenta ink nozzle row MD, a light magenta ink nozzle row ML, and a yellow ink nozzle row YD. The nozzle rows are provided with a plurality of (in this embodiment, n) nozzles from which ink for the respective colors is ejected.

A plurality of nozzles of the nozzle groups are arranged at a constant spacing (nozzle pitch: k·D) in the paper carrying direction. Here, D is the minimum dot pitch in the paper carrying direction (that is, the spacing at the highest resolution of the dots formed on the paper S). Moreover, k is an integer of 1 or more.

The nozzles of the nozzle groups are assigned numbers that become smaller toward the downstream side (#1 to #n). The paper width sensor 54 is provided slightly downstream of the nozzle #n that is on the downstream side of the furthest downstream nozzle group in respect to the paper carrying direction. Each nozzle is provided with a piezo element (not shown) as a drive element for driving the nozzle and making it eject ink droplets.

In this embodiment, the head 21 has a plurality of nozzle groups. The arrangement of the plurality of nozzle groups is discussed in detail later. However, in the description discussed later, the nozzle groups are described having only a black ink nozzle row. This is for the sake of simplifying the description by omitting the description of nozzle rows for other colors because the manner in which dots are formed is the same also in the cases of the nozzle rows for other colors. In the diagram, the head 21 has two nozzle groups. However, it is sufficient that the number of nozzle groups is more than one, and the number is not limited to two.

During printing, the paper S is carried intermittently by the paper carrying unit 10 using a predetermined carry amount, and between these intermittent carries the carriage 41 is moved in the scanning direction and ink droplets are ejected from the nozzles.

===Examples for Reference===

First, print modes in the case where a single nozzle group is disposed along the carrying direction are described as examples for reference.

<Regarding Interlaced Printing 1>

Figure 8A:
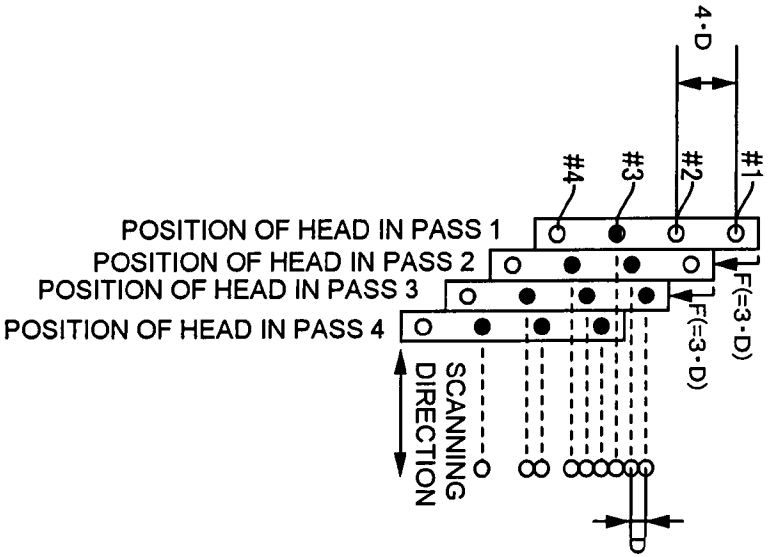
FIGS. 8A and 8B are explanatory diagrams of ordinary interlaced printing.
Figure 8B:
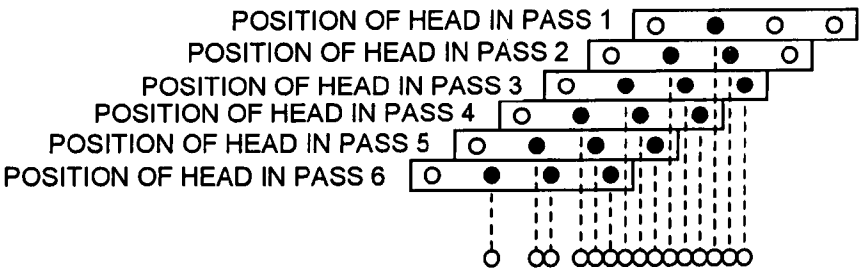

FIGS. 8A and 8B are first explanatory diagrams of ordinary interlaced printing. It should be noted that, for convenience sake, the head (or the nozzle group) is illustrated as moving with respect to the paper, but FIGS. 8A and 8B diagrams show the relative positions of the head and the paper, and in practice the paper is moved in the carrying direction. Moreover, in FIGS. 8A and 8B, a nozzle shown by a solid circle is a nozzle that is allowed to eject ink, and a nozzle shown by an open circle is a nozzle that is not allowed to eject ink. FIG. 8A shows the positions of the head (or the nozzle group) and the manner in which dots are formed in passes 1 to 4, and FIG. 8B shows the positions of the head and the manner in which dots are formed in passes 1 to 6.

Here, "interlaced mode" refers to a print mode in which k is at least 2 and a raster line that is not recorded is sandwiched between raster lines that are recorded in a single pass. Moreover, the "pass" refers to a single scanning movement in which the nozzles are moved and scan in the scanning direction. The "raster line" is a row of pixels lined up in the scanning direction, and is also referred to as a "scan line". Moreover, the "pixels" are square grids that are determined in a virtual manner on the medium to be printed in order to define the positions where ink droplets are made to land so as to record dots.

With interlaced printing, every time the paper is carried in the carrying direction by a constant carry amount F, each nozzle records a raster line immediately above the raster line that was recorded in the previous pass. In order to perform recording while keeping the carry amount constant in this manner, the number N (integer) of nozzles that are allowed to eject ink and k are coprime, and the carry amount F is set to N·D.

In FIGS. 8A and 8B, the nozzle group has four nozzles arranged in the carrying direction. However, since the nozzle pitch k of the nozzle group is 4, not all the nozzles can be used so that the condition for performing interlaced printing, that is, "N and k are coprime", is satisfied. Therefore, three of the four nozzles are used to perform interlaced printing. Moreover, since three nozzles are used, the paper is carried using a carry amount of 3·D. As a result, for example, dots are formed on the paper with a dot spacing of 720 dpi (=D) using the nozzle group with a nozzle pitch of 180 dpi (4·D).

FIGS. 8A and 8B show the manner in which continuous raster lines are formed, with the first raster line being formed by the nozzle #1 in the pass 3, the second raster line being formed by the nozzle #2 in the pass 2, the third raster line being formed by the nozzle #3 in the pass 1, and the fourth raster line being formed by the nozzle #1 in the pass 4. It should be noted that only the nozzle #3 ejects ink in the pass 1 and only the nozzle #2 and the nozzle #3 eject ink in the pass 2. The reason for this is that if ink is ejected from all of the nozzles in the pass 1 and the pass 2, continuous raster lines cannot be formed on the paper. In the pass 3 and thereafter, the three nozzles (#1 to #3) eject ink and the paper is carried by a constant carry amount F (=3·D), and thus continuous raster lines are formed with a dot spacing of D.

<Regarding Interlaced Printing 2>

Figure 9A:
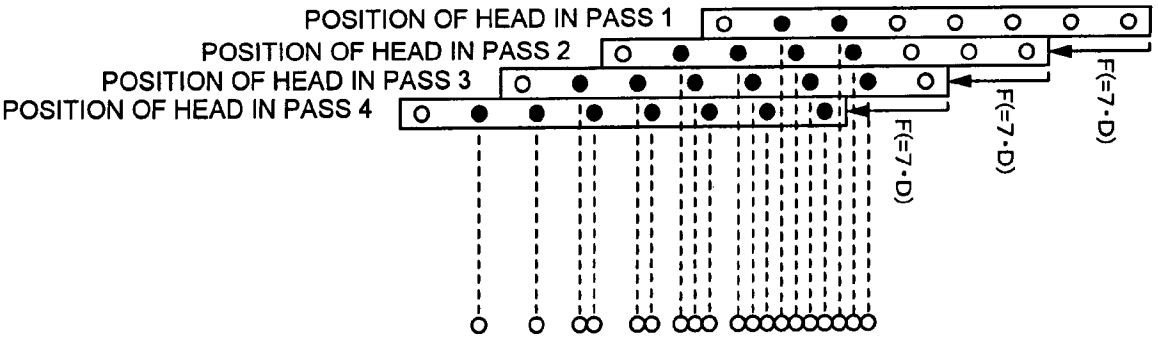
FIGS. 9A and 9B are explanatory diagrams of ordinary interlaced printing.
Figure 9B:
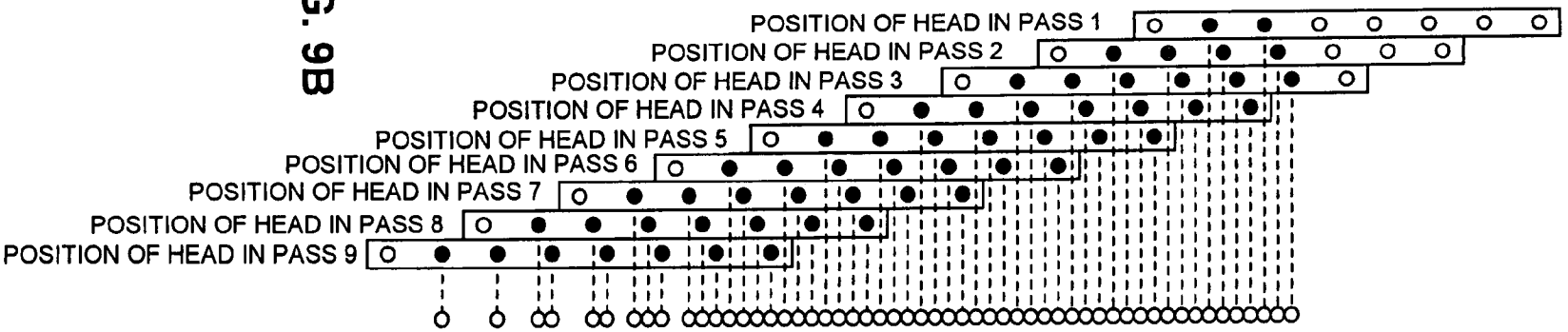

FIGS. 9A and 9B are second explanatory diagrams of ordinary interlaced printing. As compared with the first explanatory diagrams described above, the number of nozzles contained in the head (nozzle group) is different. The nozzle pitch, for example, is the same as in the case of the above-described explanatory diagrams, so that the description thereof is omitted.

In FIGS. 9A and 9B, the nozzle group has eight nozzles arranged in the carrying direction. However, since the nozzle pitch k of the nozzle group is 4, not all the nozzles can be used so that the condition for performing interlaced printing, that is, "N and k are coprime", is satisfied. Therefore, seven of the eight nozzles are used to perform interlaced printing. Moreover, since seven nozzles are used, the paper is carried using a carry amount of 7·D.

FIGS. 9A and 9B show the manner in which continuous raster lines are formed, with the first raster line being formed by the nozzle #2 in the pass 3, the second raster line being formed by the nozzle #4 in the pass 2, the third raster line being formed by the nozzle #6 in the pass 1, and the fourth raster line being formed by the nozzle #1 in the pass 4. In the pass 3 and thereafter, the seven nozzles (#1 to #7) eject ink and the paper is carried using a constant carry amount F (=7·D), and thus continuous raster lines are formed with a dot spacing of D.

As compared with the above-described interlaced printing, the number of nozzles contained in the head (nozzle group) is increased. Therefore, the number N of nozzles that are allowed to eject ink is increased, so that the carry amount F during a single carry is increased, and thus the printing speed is increased. In this manner, when interlaced printing is performed, it is advantageous to increase the number of nozzles that are allowed to eject ink because the printing speed is increased.

<Regarding Overlap Printing>

Figure 10A:
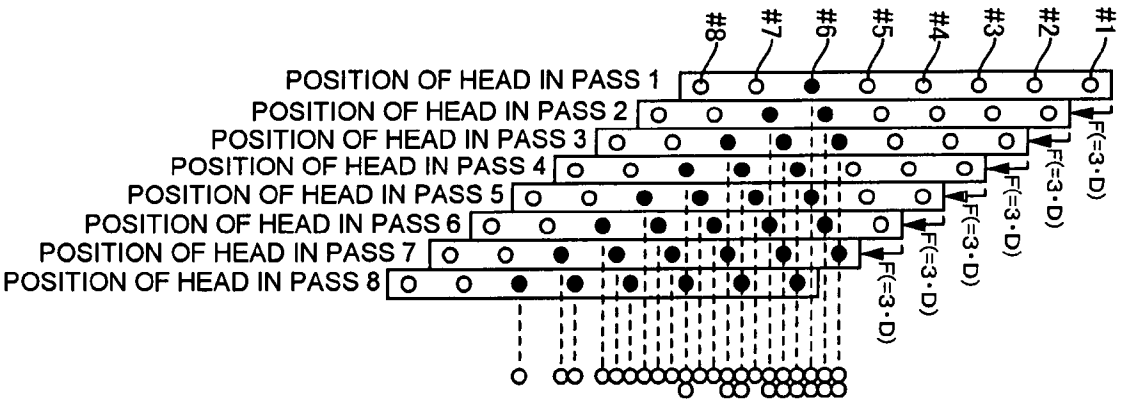
FIGS. 10A and 10B are explanatory diagrams of ordinary overlap printing.
Figure 10B:
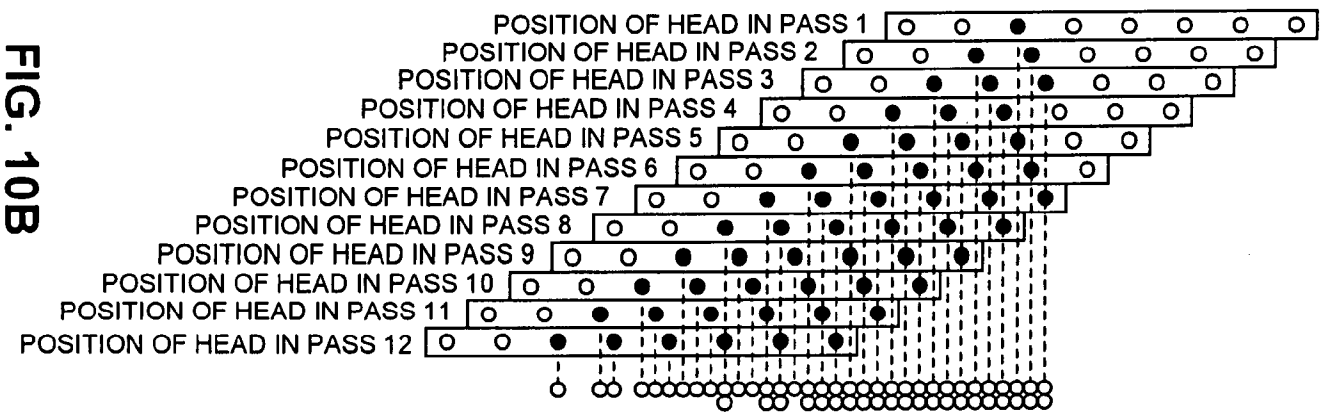

FIGS. 10A and 10B are explanatory diagrams of ordinary overlap printing. In the above-described interlaced printing, a single raster line is formed by a single nozzle. On the other hand, in overlap printing, a single raster line is formed by two or more nozzles, for example.

In overlap printing, every time the paper is carried in the carrying direction by a constant carry amount F, each nozzle forms dots intermittently every several dots. Then, another nozzle forms dots in another pass so as to complement the intermittent dots that have already been formed, and thus a single raster line is completed by a plurality of nozzles. The overlap number M is defined as the number of passes needed to complete a single raster line. In FIGS. 10A and 10B, since each nozzle forms a dot intermittently every other dot, a dot is formed every pass at the odd-numbered pixels or at the even-numbered pixels. Since a single raster line is formed by two nozzles, the overlap number M=2. It should be noted that in the case of the above-described interlaced printing, the overlap number M=1.

In overlap printing, the conditions for performing recording while keeping the carry amount constant are: (1) N/M is an integer; (2) N/M and k are coprime; and (3) the carry amount F is set to (N/M)·D.

In FIGS. 10A and 10B, the nozzle group has eight nozzles arranged in the carrying direction. However, since the nozzle pitch k of the nozzle group is 4, not all the nozzles can be used so that the condition for performing overlap printing, that is, "N/M and k are coprime", is satisfied. Therefore, six of the eight nozzles are used to perform interlaced printing. Moreover, since six nozzles are used, the paper is carried using a carry amount of 3·D. As a result, dots are formed on the paper with a dot spacing of 720 dpi (=D) using the nozzle group with a nozzle pitch of 180 dpi (4·D), for example. Furthermore, in a single pass, each nozzle forms a dot intermittently every other dot in the scanning direction. In the diagrams, raster lines for which two dots are illustrated in the scanning direction have already been completed. For example, in FIG. 10A, the first through the sixth raster lines have already been completed. The raster lines for which one dot is illustrated are raster lines in which a dot is formed intermittently every other dot. For example, in the seventh and the tenth raster lines, a dot is formed intermittently every other dot. It should be noted that the seventh raster line, in which a dot is formed intermittently every other dot, is completed when the nozzle #1 in the pass 9 forms dots so as to complement the intermittent dots.

FIGS. 10A and 10B show the manner in which continuous raster lines are formed, with the first raster line being formed by the nozzle #4 in the pass 3 and the nozzle #1 in the pass 7, the second raster line being formed by the nozzle #5 in the pass 2 and the nozzle #2 in the pass 6, the third raster line being formed by the nozzle #6 in the pass 1 and the nozzle #3 in the pass 5, and the fourth raster line being formed by the nozzle #4 in the pass 4 and the nozzle #1 in the pass 8. It should be noted that in the passes 1 to 6, some of the nozzles #1 to #6 do not eject ink. The reason for this is that if ink is ejected from all of the nozzles in the passes 1 to 6, continuous raster lines cannot be formed on the paper. In the pass 7 and thereafter, the six nozzles (#1 to #6) eject ink and the paper is carried using a constant carry amount F (=3·D), and thus continuous raster lines are formed with a dot spacing of D.

TABLE 1

| pass | 1 | 2 | 3 | 4 | 5 | 6 | 7 | 8 |
|---|---|---|---|---|---|---|---|---|
| recorded pixels | odd | even | odd | even | even | odd | even | odd |

Table 1 is a table for describing the positions in the scanning direction where dots are formed in each pass. In the table, "odd" means that dots are formed at odd-numbered pixels of the pixels lined up in the scanning direction (pixels in a raster line). Moreover, "even" in the table means that dots are formed at even-numbered pixels of the pixels lined up in the scanning direction. For example, in the pass 3, the nozzles form dots at odd-numbered pixels. When a single raster line is formed by M nozzles, k×M passes are required in order to complete the raster lines corresponding to the amount of the nozzle pitch. For example, in this embodiment, a single raster line is formed by two nozzles, so that 8 (4×2) passes are required in order to complete four raster lines. As can be seen from Table 1, in the four passes during the first half, dots are formed in the order of odd-even-odd-even. Consequently, when the four passes during the first half have finished, dots are formed at even-numbered pixels in raster lines adjacent to raster lines in which dots are formed at odd-numbered pixels. In the four passes during the second half, dots are formed in the order of even-odd-even-odd. In other words, in the four passes during the second half, dots are formed in reverse order with respect to the four passes during the first half. Consequently, dots are formed so as to fill up gaps between the dots that have been formed in the passes during the first half.

Also in overlap printing, when the number N of nozzles that are allowed to eject ink is increased, the carry amount F during a single carry is increased, and thus the printing speed is increased, as in the above-described interlaced printing. Therefore, when overlap printing is performed, it is advantageous to increase the number of nozzles that are allowed to eject ink because the printing speed is increased.

===Printing Using a Plurality of Nozzle Groups (Simplified Models)===

Next, printing using a plurality of nozzle groups of the present embodiment is described. Various operations of the printer described below are executed by the CPU 61 controlling the units based on a program stored in the memory 65 within the printer. Moreover, this program is constituted by codes for performing the various operations described below. It should be noted that in the description below, the concepts of the dot spacing (D), the nozzle pitch (k·D), the number (N) of nozzles that are allowed to eject ink, the carry amount (F), and the overlap number (M), for example, are the same as those in the above-described examples for reference, so that the descriptions thereof are omitted.

<Interlaced Printing Using Two Nozzle Groups 1>

Figure 11A:
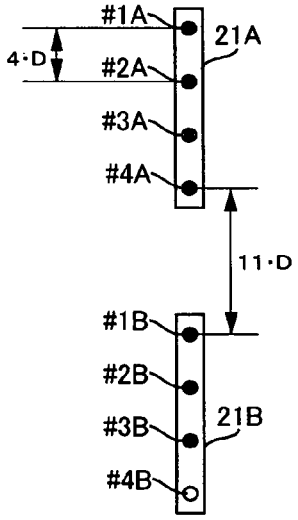
FIG. 11A is a diagram showing a configuration of a plurality of nozzle groups.
Figure 11B:
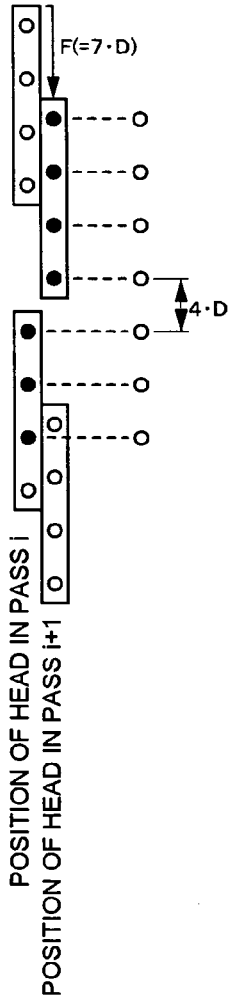
FIG. 11B is an explanatory diagram of a distance between the nozzle groups.
Figure 11C:
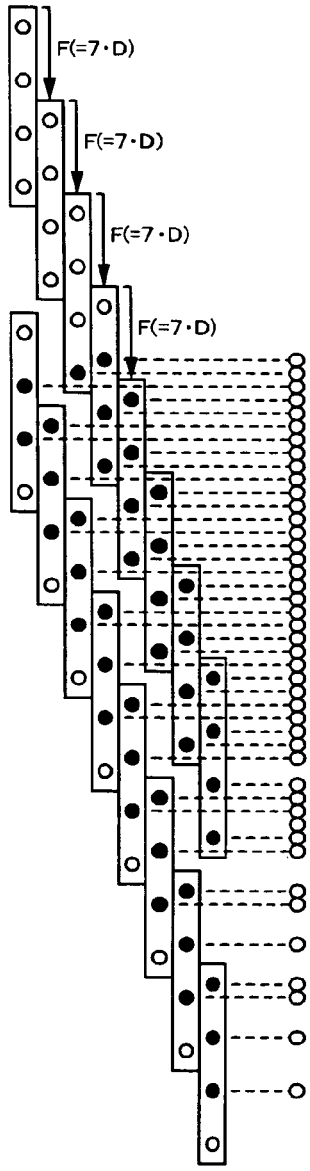
FIG. 11C is an explanatory diagram of printing using the plurality of nozzle groups.

FIG. 11A is an explanatory diagram of a configuration of a plurality of nozzle groups of this embodiment. FIG. 11B is an explanatory diagram of the distance between the plurality of nozzle groups of this embodiment. FIG. 11C is an explanatory diagram of interlaced printing using the plurality of nozzle groups of this embodiment.

A head in this embodiment is provided with two nozzle groups (a first nozzle group 21A and a second nozzle group 21B). Each of the first nozzle group 21A and the second nozzle group 21B has four nozzles. The nozzle pitch in each nozzle group is 4·D (k=4), as is the case with the examples for reference described above.

The head of this embodiment is provided such that the distance between the nozzle groups (more specifically, the distance between the nozzle #4A of the first nozzle group 21A and the nozzle #1B of the second nozzle group 21B) is 11·D. In other words, the head of this embodiment is provided such that the distance between the nozzle groups is equal to the sum of the carry amount (7·D) and the nozzle pitch (4·D). Thus, dots that have been formed by the nozzles of the nozzle group 21B in a given pass (pass i) and dots that have been formed by the nozzles of the nozzle group 21A in the subsequent pass (pass i+1) are formed continuously in the carrying direction with a spacing of 4·D.

That is, according to the head of this embodiment, by being carried by a predetermined carry amount (7·D), the first nozzle group 21A in the pass i+1 and the second nozzle group 21B in the pass i function in a pseudo manner as eight nozzles that are arranged with a nozzle pitch of 4·D (see FIG. 11B).

In this embodiment, the two nozzle groups function in a pseudo manner as eight nozzles that are arranged with a nozzle pitch 4·D, so that when interlaced printing is performed, seven of the eight nozzles are used (seven nozzles are allowed to eject ink), as described in the examples for reference above. Furthermore, since seven nozzles are used, the paper is carried using a carry amount of 7·D when performing interlaced printing.

FIG. 11C shows the manner in which continuous raster lines are formed, with the first raster line being formed by the nozzle #2A in the pass 4, the second raster line being formed by the nozzle #4A in the pass 3, the third raster line being formed by the nozzle #2B in the pass 1, and the fourth raster line being formed by the nozzle #1 in the pass 5. It should be noted that in the passes 1 to 4, some nozzles of the seven nozzles (nozzles #1A to #4A and nozzles #1B to #3B) that are normally used do not eject ink. The reason for this is that if ink is ejected from all of the nozzles in the passes 1 to 4, continuous raster lines can not be formed on the paper. In the pass 5 and thereafter, the seven nozzles (nozzles #1A to #4A and nozzles #1B to #3B) eject ink and the paper is carried using a constant carry amount F (=7·D), and thus continuous raster lines are formed with a dot spacing of D.

According to this embodiment, the number of nozzles that are allowed to eject ink is increased relative to the interlaced printing using four nozzles (example for reference), so that the printing speed is advantageously increased.

Moreover, according to this embodiment, when compared to the interlaced printing using one nozzle group having eight nozzles (example for reference), it is possible to produce a head by separating the nozzle group into two parts, so that design flexibility when producing the head is improved. As a result, the head can be produced inexpensively. In particular, the distance between the two nozzle groups can be larger than the nozzle pitch (k·D), and thus design flexibility when producing the head is improved.

<Interlaced Printing Using Two Nozzle Groups 2>

Figure 12A:
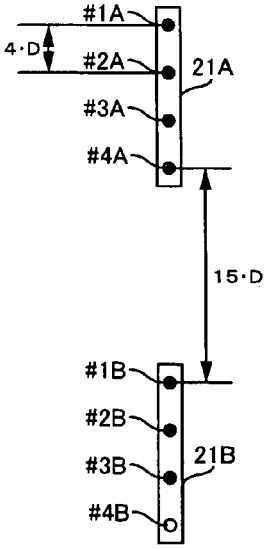
FIG. 12A is a diagram showing a configuration of a plurality of nozzle groups.
Figure 12B:
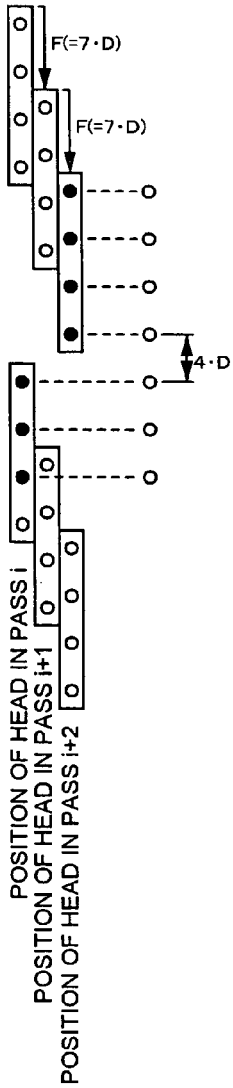
FIG. 12B is an explanatory diagram of a distance between the nozzle groups.
Figure 12C:
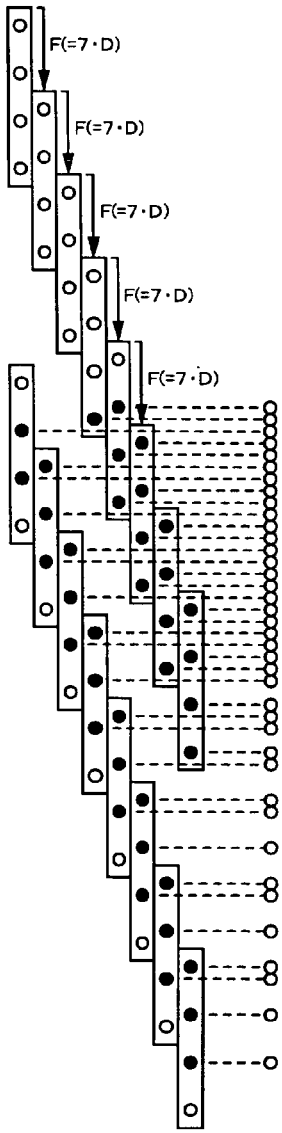
FIG. 12C is an explanatory diagram of printing using the plurality of nozzle groups.

FIG. 12A is an explanatory diagram of a configuration of a plurality of nozzle groups of this embodiment. FIG. 12B is an explanatory diagram of the distance between the plurality of nozzle groups of this embodiment. FIG. 12C is an explanatory diagram of interlaced printing using the plurality of nozzle groups of this embodiment. This embodiment as compared with the above-described embodiment is different in the distance between the two nozzle groups. Other aspects are substantially the same as in the above-described embodiment, so that the description thereof is omitted.

A head of this embodiment is provided such that the distance between the nozzle groups (more specifically, the distance between the nozzle #4A of the first nozzle group 21A and the nozzle #1B of the second nozzle group 21B) is 15·D. In other words, the head of this embodiment is provided such that the distance between the nozzle groups is equal to the sum of twice the carry amount (7·D) and the nozzle pitch (4·D). Thus, dots that have been formed by the nozzles of the nozzle group 21B in a given pass (pass i) and dots that have been formed by the nozzles of the nozzle group 21A in the second next pass (pass i+2) are formed continuously in the carrying direction with a spacing of 4·D.

That is, according to the head of this embodiment, by being carried by a predetermined carry amount (7·D×2), the first nozzle group 21A in the pass i+2 and the second nozzle group 21B in the pass i function in a pseudo manner as eight nozzles that are arranged with a nozzle pitch of 4·D (see FIG. 12B).

In this embodiment, the two nozzle groups function in a pseudo manner as eight nozzles that are arranged with a nozzle pitch of 4·D, so that when interlaced printing is performed, seven of the eight nozzles are used (seven nozzles are allowed to eject ink), as described in the examples for reference above. Furthermore, since seven nozzles are used, the paper is carried using a carry amount of 7·D when performing interlaced printing.

FIG. 12C shows the manner in which continuous raster lines are formed, with the first raster line being formed by the nozzle #2A in the pass 5, the second raster line being formed by the nozzle #4A in the pass 4, the third raster line being formed by the nozzle #2B in the pass 1, and the fourth raster line being formed by the nozzle #1 in the pass 6. It should be noted that in the passes 1 to 5, some nozzles of the seven nozzles (nozzles #1A to #4A and nozzles #1B to #3B) that are normally used do not eject ink. The reason for this is that if ink is ejected from all of the nozzles in the passes 1 to 4, continuous raster lines cannot be formed on the paper. In the pass 5 and thereafter, the seven nozzles (nozzles #1A to #4A and nozzles #1B to #3B) eject ink and the paper is carried using a constant carry amount F (=7·D), and thus continuous raster lines are formed with a dot spacing of D.

According to this embodiment, it is possible to achieve more advantageous effects than in the examples for reference, as in the case of the above-described embodiment.

As is apparent from both of this embodiment and the above-described embodiment, the conditions for performing interlaced printing satisfy the conditions of ordinary interlaced printing (see examples for reference), and also include the condition that the distance between the nozzle groups is $(\alpha \times F)+(k \cdot D)$ (a is an integer). It should be noted that in the conditions for performing ordinary interlaced printing, the nozzle pitch (k·D), the number (N) of nozzles that are allowed to eject ink, and the carry amount (F) are closely related to each other. In other words, the conditions for performing ordinary interlaced printing are: (1) the number N (integer) of nozzles that are allowed to eject ink and k are coprime; and (2) the carry amount F is set to N·D.

<Interlaced Printing Using Three Nozzle Groups>

Figure 13A:
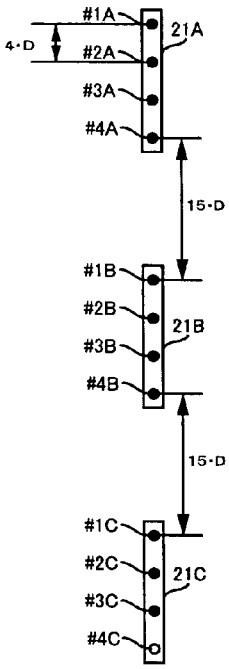
FIG. 13A is a diagram showing a configuration of a plurality of nozzle groups.
Figure 13B:
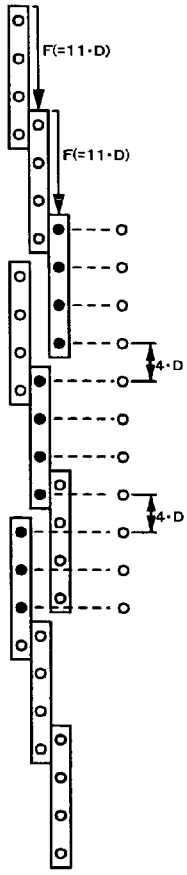
FIG. 13B is an explanatory diagram of a distance between the nozzle groups.
Figure 13C:
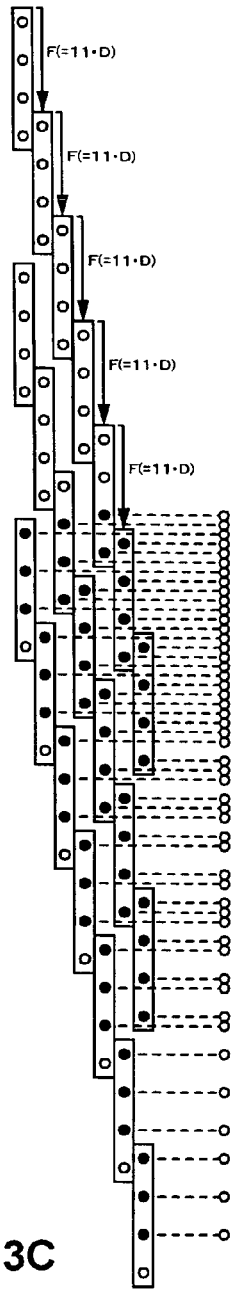
FIG. 13C is an explanatory diagram of printing using the plurality of nozzle groups.

FIG. 13A is an explanatory diagram of a configuration of a plurality of nozzle groups of this embodiment. FIG. 13B is an explanatory diagram of the distance between heads of the plurality of nozzle groups of this embodiment. FIG. 13C is an explanatory diagram of interlaced printing using the plurality of nozzle groups of this embodiment. This embodiment is different from the above-described embodiments in the number of nozzle groups.

A head of this embodiment is provided with three nozzle groups (a first nozzle group 21A, a second nozzle group 21B, and a third nozzle group 21C). The nozzle groups each have four nozzles. The nozzle pitch in the nozzle groups is 4·D (k=4) as is the case with the examples for reference discussed above.

The head of this embodiment is provided such that the distance between the nozzle groups (more specifically, the distance between the nozzle #4A of the first nozzle group 21A and the nozzle #1B of the second nozzle group 21B, and the distance between the nozzle #4B of the second nozzle group 21B and the nozzle #1C of the third nozzle group 21C) is 11·D. In other words, the head of this embodiment is provided such that the distance between the nozzle groups is equal to the sum of the carry amount (11·D) and the nozzle pitch (4·D). Thus, dots that have been formed by the nozzles of the nozzle group 21B in a given pass (pass i) and dots that have been formed by the nozzles of the nozzle group 21A in the subsequent pass (pass i+1) are formed continuously in the carrying direction with a spacing of 4·D. Moreover, thus, dots that have been formed by the nozzles of the nozzle group 21C in a given pass (pass i) and dots that have been formed by the nozzles of the nozzle group 21B in the subsequent pass (pass i+1) are formed continuously in the carrying direction with a spacing of 4·D.

That is, according to the head of this embodiment, by being carried by a predetermined carry amount (11·D), the nozzle groups function in a pseudo manner as twelve nozzles that are arranged with a nozzle pitch of 4·D (see FIG. 12B).

In this embodiment, the three nozzle groups function in a pseudo manner as twelve nozzles that are arranged with a nozzle pitch of 4·D, so that when interlaced printing is performed, eleven of the twelve nozzles are used (eleven nozzles are allowed to eject ink). Furthermore, since eleven nozzles are used (N=11), the paper is carried using a carry amount of 11·D when performing interlaced printing.

FIG. 13C shows the manner in which continuous raster lines are formed, with the first raster line being formed by the nozzle #3A in the pass 5, the second raster line being formed by the nozzle #2B in the pass 3, the third raster line being formed by the nozzle #1C in the pass 1, and the fourth raster line being formed by the nozzle #1A in the pass 6. It should be noted that in the passes 1 to 5, some nozzles of the eleven nozzles (nozzles #1A to #4A, nozzles #1B to #4B, and nozzles #1C to #3C) that are normally used do not eject ink. The reason for this is that if ink is ejected from all of the nozzles in the passes 1 to 5, continuous raster lines cannot be formed on the paper. In the pass 5 and thereafter, the eleven nozzles (nozzles #1A to #4A, nozzles #1B to #4B, and nozzles #1C to #3C) eject ink and the paper is carried using a constant carry amount F (=11·D), and thus continuous raster lines are formed with a dot spacing of D.

According to this embodiment, it is possible to achieve more advantageous effects than in the examples for reference, as is the case in the above-described embodiments.

Moreover, according to this embodiment, the number of nozzle groups is increased compared to the above-described embodiments, so that the number of nozzles that are allowed to eject ink can be increased. Therefore, this embodiment is advantageous because the number of nozzles that are allowed to eject ink is increased and thus the printing speed is increased.

It should be noted that according to this embodiment, the distance between the nozzle groups was 11·D, but this is not a limitation. Moreover, according to this embodiment, the distance between the nozzle group 21A and the nozzle group 21B is equal to the distance between the nozzle group 21B and the nozzle group 21C. However, this is not a limitation. The point is that it is sufficient that each distance between the nozzle groups satisfies $(\alpha \times F)+(k \cdot D)$ ($\alpha$ is an integer).

According to this embodiment, the number of nozzles that are allowed to eject ink of the first nozzle group 21A was equal to the number of nozzles that are allowed to eject ink of the second nozzle group 21B. In this manner, when interlaced printing is performed using a head provided with three nozzle groups, it is desirable to set the number of nozzles that are allowed to eject ink of two nozzle groups to be equal to each other and to set the number of nozzles that are allowed to eject ink of the other nozzle group such that the total (N) of the number of nozzles that are allowed to eject ink satisfies the conditions of interlaced printing.

<Overlap Printing Using Two Nozzle Groups>

Figure 14A:
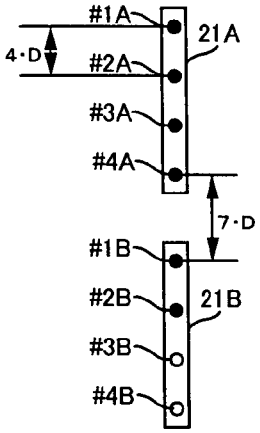
FIG. 14A is a diagram showing a configuration of a plurality of nozzle groups.
Figure 14B:
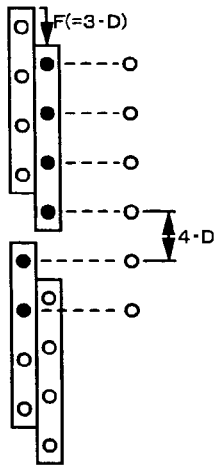
FIG. 14B is an explanatory diagram of a distance between the plurality of nozzle groups.

FIG. 14A is an explanatory diagram of a configuration of a plurality of nozzle groups of this embodiment. FIG. 14B is an explanatory diagram of the distance between heads of the plurality of nozzle groups of this embodiment. FIG. 11C is an explanatory diagram of overlap printing using the plurality of nozzle groups of this embodiment.

A head of this embodiment is provided with two nozzle groups (a first nozzle group 21A and a second nozzle group 21B). Each of the first nozzle group 21A and the second nozzle group 21B has four nozzles. The nozzle pitch in each nozzle group is 4·D (k=4), as is the case with the examples for reference discussed above.

The head of this embodiment is provided such that the distance between the nozzle groups (more specifically, the distance between the nozzle #4A of the first nozzle group 21A and the nozzle #1B of the second nozzle group 21B) is 7·D. In other words, the head of this embodiment is provided such that the distance between the nozzle groups is equal to the sum of the carry amount (3·D) and the nozzle pitch (4·D). Thus, dots that have been formed by the nozzles of the nozzle group 21B in a given pass (pass i) and dots that have been formed by the nozzles of the nozzle group 21A in the subsequent pass (pass i+1) are formed continuously in the carrying direction with a spacing of 4·D.

That is, according to the head of this embodiment, by being carried by a predetermined carry amount (3·D), the first nozzle group 21A in the pass i+1 and the second nozzle group 21B in the pass i function in a pseudo manner as eight nozzles that are arranged with a nozzle pitch of 4·D (see FIG. 14B).

In this embodiment, the two nozzle groups function in a pseudo manner as eight nozzles that are arranged with a nozzle pitch of 4·D, so that when overlap printing is performed, six of the eight nozzles are used (six nozzles are allowed to eject ink), as described in the examples for reference above. Furthermore, since six nozzles are used (N=6), the paper is carried using a carry amount of 3·D (=(N/M)·D) when performing overlap printing (provided M=2).

Figure 14C:
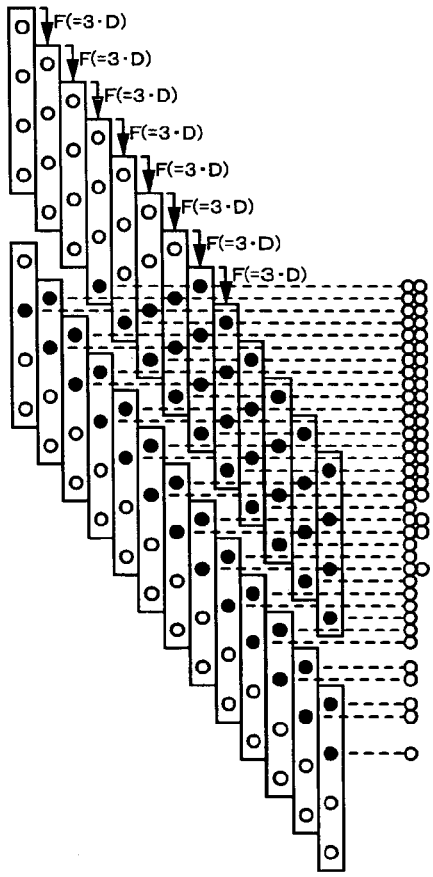
FIG. 14C is an explanatory diagram of printing using the plurality of nozzle groups.

FIG. 14C shows the manner in which continuous raster lines are formed, with the first raster line being formed by the nozzle #4A in the pass 4 and the nozzle #1 in the pass 8, the second raster line being formed by the nozzle #1B in the pass 2 and the nozzle #2A in the pass 7, the third raster line being formed by the nozzle #2B in the pass 1 and the nozzle #3A in the pass 6, and the fourth raster line being formed by the nozzle #4A in the pass 5 and the nozzle #1A in the pass 9. It should be noted that in the passes 1 to 7, some nozzles of the six nozzles (nozzles #1A to #4A and nozzles #1B and #2B) that are normally used do not eject ink. The reason for this is that if ink is ejected from all of the nozzles in the passes 1 to 7, continuous raster lines cannot be formed on the paper. In the pass 8 and thereafter, the six nozzles (nozzles #1A to #4A and nozzles #1B and #2B) eject ink and the paper is carried using a constant carry amount F (=3·D), and thus continuous raster lines are formed with a dot spacing of D.

TABLE 2

| pass | 1 | 2 | 3 | 4 | 5 | 6 | 7 | 8 |
|---|---|---|---|---|---|---|---|---|
| recorded pixels | | | | | | | | |
| nozzle group A | odd | odd | even | odd | even | even | odd | even |
| nozzle group B | odd | even | odd | even | even | odd | even | odd |

Table 2 is a table for describing the positions in the scanning direction where dots are formed in each pass. Since the table is read in the same manner as in the case of Table 2, the description thereof is omitted. When a single raster line is formed by M nozzles, k×M+α passes are required in order to complete the raster lines corresponding to the amount of the nozzle pitch. For example, in this embodiment, a single raster line is formed by two nozzles, and α=1, so that 9 (4×2+1) passes are required in order to complete four raster lines. As can be seen from Table 2, the positions where dots are formed in each pass of the second nozzle group are the same as those in the case of Table 1. That is, the second nozzle group forms dots in the order of odd-even-odd-even in four passes during the first half, and forms dots in the order of even-odd-even-odd in four passes during the second half. On the other hand, the order of the positions where dots are formed in each pass of the first nozzle group is misaligned by an amount corresponding to ax passes with respect to the order in the case of the second nozzle group. In this embodiment, since α=1, dots are formed in the order of odd-even-odd-even in the passes 2 to 5, and dots are formed in the order of even-odd-even-odd in the passes 6 to 9 (pass 1). It should be noted that if a is a multiple of k×M, then the positions where dots are formed of the first nozzle group are the same with those of the second nozzle group, so that ink can be ejected from the nozzles at the same timing between the nozzle groups.

According to this embodiment, when compared to the overlap printing using one nozzle group having eight nozzles (example for reference), it is possible to produce a head by separating the nozzle group into two parts, so that design flexibility when producing the head is improved. As a result, the head can be produced inexpensively. In particular, the distance between the two nozzle groups can be larger than the nozzle pitch (k·D), and thus design flexibility when producing the head is improved.

The conditions for performing overlap printing of this embodiment satisfy the conditions of ordinary overlap printing (see example for reference), and also include the condition that the distance between the nozzle groups is (α×F)+(k·D) (α is an integer). It should be noted that, in the conditions for performing ordinary overlap printing, the nozzle pitch (k·D), the number (N) of nozzles that are allowed to eject ink, and the carry amount (F) are closely related to each other. That is, the conditions for performing ordinary overlap printing are: (1) N/M is an integer; (2) N/M and k are coprime; and (3) the carry amount F is set to (N/M)·D.

Moreover, according to this embodiment, overlap printing was performed using two nozzle groups. However, this is not a limitation. For example, overlap printing can be performed using three nozzle groups or using more than three nozzle groups. Furthermore, when three or more nozzle groups are used, the distances between the nozzle groups do not have to be equal, and it is sufficient that each distance between the nozzle groups satisfies (α×F)+(k·D) (α is an integer).

<Head Sharing >

According to the examples for reference (FIGS. 9B and 10B) discussed above, the same head could be used to perform both interlaced printing and overlap printing. On the other hand, according to the present embodiments described above, the distance between the nozzle groups was defined by a predetermined condition, so that the head that was used in the case of interlaced printing (for example, FIG. 11C) was different from that in the case of overlap printing (for example, FIG. 14C).

However, it is not practical to prepare different heads for different print modes. Moreover, it is convenient for a user that interlaced printing and overlap printing can be performed using the same head.

Thus, in the following, a head that can be used in different print modes is described.

Figure 15A:
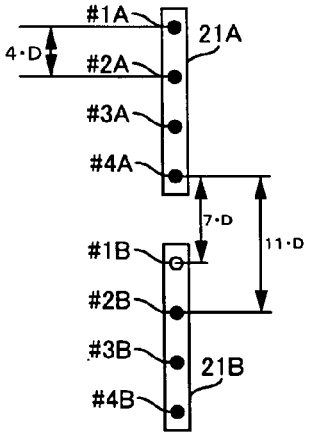
FIG. 15A is an explanatory diagram of a head used for two purposes.
Figure 15B:
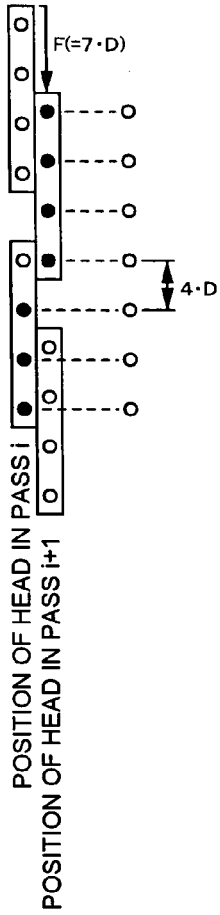
FIG. 15B is an explanatory diagram of a distance between nozzles that eject ink.
Figure 15C:
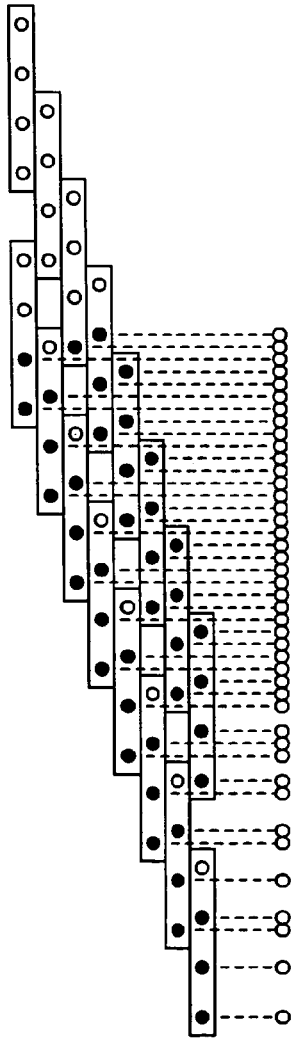
FIG. 15C is an explanatory diagram of printing when the head is used for two purposes.

FIGS. 15A to 15C are explanatory diagrams of interlaced printing using the head that was used in the embodiment of overlap printing described above. When compared to the embodiment of FIGS. 11A to 11C described above, the distance between the nozzle groups is different, and also the nozzles that are allowed to eject ink of the second nozzle group 21B are different. For example, FIG. 15C for this embodiment is different from FIG. 11C for the above-described embodiment in that the third raster line is formed by the nozzle #3B in the pass 1 in this embodiment.

The head of this embodiment is provided such that the distance between the nozzle #4A of the first nozzle group 21A and the nozzle #1B of the second nozzle group 21B is 7·D, as in the case of the head that was used in the embodiment of overlap printing described above. That is, in the head of this embodiment, the distance between the nozzle #4A of the first nozzle group 21A and the nozzle #2B of the second nozzle group 21B is 11·D. Therefore, in this embodiment, interlaced printing is performed using the nozzle #1B of the second nozzle group 21B as the nozzle that is not allowed to eject ink and the nozzles #1A to #4A of the first nozzle group 21A and the nozzles #2B to #4B of the second nozzle group 21B as the nozzles that are allowed to eject ink.

In this embodiment, the distance between two adjacent nozzles that are allowed to eject ink and that belong to different nozzle groups (the distance between the nozzle #4A of the first nozzle group 21A and the nozzle #2B of the second nozzle group 21B) is equal to the sum of the carry amount (7·D) and the nozzle pitch (4·D). Thus, dots that have been formed by the nozzles of the nozzle group 21B in a given pass (pass i) and dots that have been formed by the nozzles of the nozzle group 21A in the subsequent pass (pass i+1) are formed continuously in the carrying direction with a spacing of 4·D.

That is, according to the head of this embodiment, by being carried by a predetermined carry amount (7·D), the nozzles (nozzles #1A to #4A) that are allowed to eject ink of the first nozzle group 21A in the pass i+1 and the nozzles (nozzles #2B to #4B) that are allowed to eject ink of the second nozzle group 21B in the pass i function in a pseudo manner as eight nozzles that are arranged with a nozzle pitch of 4·D (see FIG. 15B).

In this manner, according to interlaced printing of this embodiment, interlaced printing can be performed using the head that can be used for overlap printing described above. That is, interlaced printing and overlap printing can be performed using the same head, so that the user can select a plurality of print modes.

It should be noted that, according to this embodiment, the distance between the two adjacent nozzles that are allowed to eject ink and that belong to different nozzle groups (the nozzle #4A of the first nozzle group 21A and the nozzle #2B of the second nozzle group 21B) is equal to the sum of the carry amount (7·D) and the nozzle pitch (4·D) and is 11·D. However, this is not a limitation. The point is that it is sufficient that the distance between two adjacent nozzles that are allowed to eject ink and that belong to different nozzle groups satisfies $(\alpha \times F)+(k \cdot D)$ (a is an integer).

Moreover, in interlaced printing of this embodiment, the nozzle #1B, which belongs to the nozzle group 21B and is on the side close to the nozzle group 21A, is used as the nozzle that is not allowed to eject ink. That is, there is a nozzle that does not eject ink between the two adjacent nozzles that are allowed to eject ink and that belong to different nozzle groups. In such a manner, the distance between the two nozzles that are allowed to eject ink can be adjusted in order to adapt to two print modes using different carry amounts without changing the configuration of the head.

Moreover, according to the head of this embodiment, two nozzle groups were used to perform interlaced printing (and overlap printing). However, this is not a limitation. For example, it is also possible to use three nozzle groups. Furthermore, when three or more nozzle groups are used, the distances between two adjacent nozzles that are allowed to eject ink and that belong to different nozzle groups do not have to be equal to each other, and it is sufficient that each distance satisfies $(\alpha \times F)+(k \cdot D)$ (ax is an integer).

It should be noted that when the head is used for a plurality of print modes, it is desirable that, if a print mode in which the overlap number is an even number, then ax, which defines the distance between the two nozzles $(\alpha \times F)+(k \cdot D)$, is an even number. In particular, when the resolution in the plurality of print modes is equal (when D in a plurality of print modes is the same), and when the overlap number of the print modes is M1 and M2 and $\alpha$ in the print modes is $\alpha 1$ and $\alpha 2$, it is preferable that $M1:M2=\alpha 1:\alpha 2$. The reason for this is that although the carry amount F in each of the print modes varies depending on the overlap number, a head with such a distance is easily used for a plurality of print modes.

===Printing Using a Plurality of Nozzle Groups (Practical Examples)===

The above-described embodiments are simplified models in which a single nozzle group is provided with only four nozzles. However, the number of nozzles of a nozzle group that is used for a device in practice is much larger than that of the above-described models so that the printing speed is increased. This is described below using a configuration of a practical nozzle group. However, the nozzle group of the simplified models described above and the practical nozzle group described below are based on the same idea of the present invention.

It should be noted that various operations of the printer that are described below are executed by the CPU 61 controlling the units based on a program stored in the memory 65 within the printer. Moreover, this program is constituted by codes for performing the various operations described below.

===Practical Example 1===

Figure 16A:
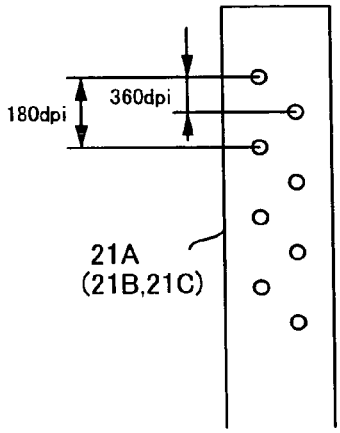
FIG. 16A is a diagram showing a configuration of a nozzle group of a first example.
Figure 16B:
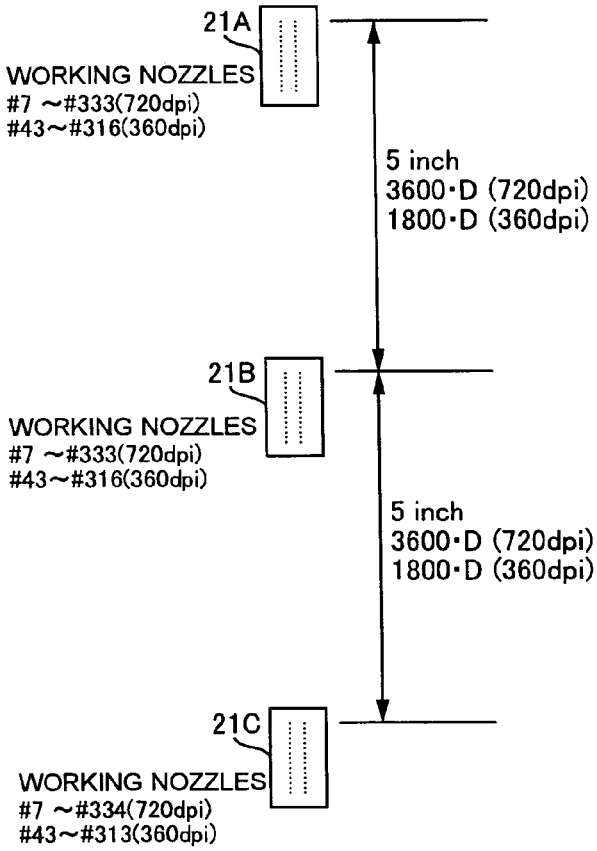
FIG. 16B is a diagram showing a configuration of a head of the first example.

FIG. 16A is an explanatory diagram of a configuration of a nozzle group that is used for the first example. FIG. 16B is an explanatory diagram of a configuration of a head that is used for the first example.

In this example, each nozzle group is provided with two nozzle rows. Each nozzle row has 180 nozzles, and the nozzle pitch is 180 dpi. Moreover, the two nozzle rows are arranged along the carrying direction such that they are misaligned by an amount of 180 dpi. Therefore, the nozzles in each nozzle group are arranged in a staggered manner. By arranging the nozzles in this manner, the nozzle groups of this example are provided with 360 nozzles and have a nozzle pitch that is substantially 360 dpi. Three nozzle groups are arranged in the carrying direction such that the distance between the nozzles #1 of the nozzle groups is 5 inches.

With the above-described head of this example, it is possible to perform "overlap printing at 720 dpi×720 dpi" and "band printing at 360 dpi×360 dpi". "Band printing" refers to a print mode in which the nozzle pitch is equal to the dot spacing D (k=1) and continuous raster lines are formed in a single pass.

When "overlap printing at 720 dpi×720 dpi" is performed, 327 nozzles, the nozzles #7 to #333, of the 360 nozzles of each of the nozzle group 21A and the nozzle group 21B serve as the nozzles that are allowed to eject ink. Moreover, 328 nozzles, the nozzles #7 to 334, of the 360 nozzles of the nozzle group 21C serve as the nozzles that are allowed to eject ink. Accordingly, a total of 982 nozzles serve as the nozzles that are allowed to eject ink. Furthermore, the distance between two adjacent nozzles that are allowed to eject ink and that belong to different nozzle groups (the distance between the nozzle #333 of the nozzle group 21A and the nozzle #7 of the nozzle group 21B and the distance between the nozzle #333 of the nozzle group 21B and the nozzle #7 of the nozzle group 21C) is 2948·D (note that D=1/720 inches). It should be noted that since printing is performed at 720 dpi, the nozzle pitch is 2·D (k=2). Moreover, the overlap number M=2, the carry amount F=491·D, and $\alpha$=6.

When "band printing at 360 dpi×360 dpi" is performed, 274 nozzles, the nozzles #43 to #316, of the 360 nozzles of each of the nozzle group 21A and the nozzle group 21B serve as the nozzles that are allowed to eject ink. Moreover, 271 nozzles, the nozzles #43 to 313, of the 360 nozzles of the nozzle group 21C serve as the nozzles that are allowed to eject ink. Accordingly, a total of 819 nozzles serve as the nozzles that are allowed to eject ink. Furthermore, the distance between two adjacent nozzles that are allowed to eject ink and that belong to different nozzle groups (the distance between the nozzle #316 of the nozzle group 21A and the nozzle #43 of the nozzle group 21B and the distance between the nozzle #316 of the nozzle group 21B and the nozzle #43 of the nozzle group 21C) is 1639·D (note that D=1/360 inches). It should be noted that since printing is performed at 360 dpi, the nozzle pitch is 1·D (k=1). Moreover, the overlap number M=1, the carry amount F=819·D, and $\alpha$=2.

Also in this example, the same effects as those in the above-described embodiments can be achieved.

Moreover, according to this example, liquid is ejected from part of a plurality of nozzles contained in each of the nozzle groups. Thus, the number of nozzles that are allowed to eject ink can be set without being limited to the number of nozzles provided in the head.

Moreover, according to this example, nozzles that are arranged at the ends of the nozzle groups do not eject ink. Thus, the number of nozzles that are allowed to eject ink can be set as appropriate according to the print mode without changing the configuration of the head.

Moreover, according to this example, there are nozzles that do not eject ink between two adjacent nozzles that are allowed to eject ink and that belong to different nozzle groups. Thus, by suitably setting the nozzles that are not allowed to eject ink, the distance between two adjacent nozzles that are allowed to eject ink and that belong to different nozzle groups can be adjusted according to the print mode without changing the configuration of the head.

Furthermore, according to this example, the nozzles that are used for overlap printing are different from the nozzles that are used for band printing. In this manner, in this example, the nozzles that eject ink differ for different recording modes.

Furthermore, according to this example, the head is designed such that a is an even number during overlap printing at a resolution of 720 dpi. Thus, it is possible to perform printing at 360 dpi, which is half of that resolution, using the same head. It should be noted that when the dot spacing D (D=1/720 inches for 720 dpi) is D1 and D2 in the respective print modes and $\alpha$ is $\alpha$1 and $\alpha$2 in the respective print modes, it is preferable that 1/D1:1/D2=$\alpha$1:$\alpha$2. This is because a head with such a distance is easily used for a plurality of modes. When a head is used for print modes with different resolutions, it is desirable that a is an even number because the resolution of one mode is often an even multiple of the resolution of the other mode.

Furthermore, according to this example, there are three nozzle groups. Further, the number of nozzles that are allowed to eject ink of the nozzle group 21A and the number of nozzles that are allowed to eject ink of the nozzle group 21B that is adjacent to the nozzle group 21A are set so as to be equal to each other.

Furthermore, according to this example, the head is designed such that $\alpha$ during overlap printing is an integral multiple of the overlap number M. Thus, the same head can be used to perform a plurality of print modes.

===Practical Example 2===

Figure 17A:
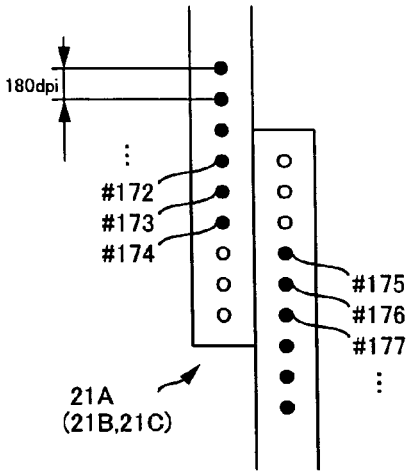
FIG. 17A is a diagram showing a configuration of a nozzle group of a second example.
Figure 17B:
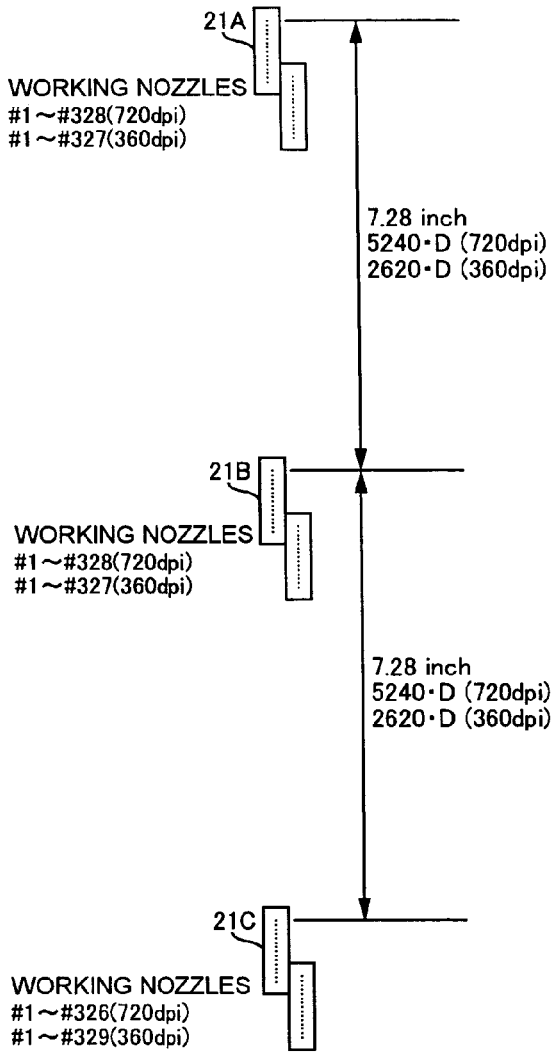
FIG. 17B is a diagram showing a configuration of a head of the second example.

FIG. 17A is an explanatory diagram of a configuration of a nozzle group that is used for the second example. FIG. 17B is an explanatory diagram of a configuration of a head that is used for the second example.

In this example, each nozzle group is provided with two nozzle rows. Each nozzle row has 180 nozzles, and the nozzle pitch is 180 dpi. Moreover, the two nozzle rows are arranged along the carrying direction such that they are misaligned by 177/180 inches. Further, three nozzles at an end of each of the nozzle rows are not used (thus, only 174 nozzles of each of the nozzle rows are used). Therefore, the nozzles within each of the nozzle groups have substantially 348 (174×2) nozzles with a nozzle pitch of 180 dpi. Three nozzle groups are arranged in the carrying direction such that the distance between the nozzles #1 of the nozzle groups is 7.28 inches.

With the above-described head of this example, it is possible to perform "overlap printing at 720 dpi×720 dpi" and "interlaced printing at 360 dpi×360 dpi" (however, this is interlaced printing in which k=2).

When "overlap printing at 720 dpi×720 dpi" is performed, 328 nozzles, the nozzles #1 to #328, of the 348 nozzles of each of the nozzle group 21A and the nozzle group 21B serve as the nozzles that are allowed to eject ink. Moreover, 326 nozzles, the nozzles #1 to 326, of the 348 nozzles of the nozzle group 21C serve as the nozzles that are allowed to eject ink. Accordingly, a total of 982 nozzles serve as the nozzles that are allowed to eject ink. Furthermore, the distance between two adjacent nozzles that are allowed to eject ink and that belong to different nozzle groups (the distance between the nozzle #328 of the nozzle group 21A and the nozzle #1 of the nozzle group 21B and the distance between the nozzle #328 of the nozzle group 21B and the nozzle #1 of the nozzle group 21C) is 3932·D (note that D=1/720 inches). It should be noted that since printing is performed at 720 dpi, the nozzle pitch is 4·D (k=4). Moreover, the overlap number M=2, the carry amount F=491·D, and $\alpha$=8.

When "interlaced printing at 360 dpi×360 dpi" is performed, 327 nozzles, the nozzles #1 to #327, of the 348 nozzles of each of the nozzle group 21A and the nozzle group 21B serve as the nozzles that are allowed to eject ink. Moreover, 329 nozzles, the nozzles #1 to 329, of the 348 nozzles of the nozzle group 21C serve as the nozzles that are allowed to eject ink. Accordingly, a total of 983 nozzles serve as the nozzles that are allowed to eject ink. Furthermore, the distance between two adjacent nozzles that are allowed to eject ink and that belong to different nozzle groups (the distance between the nozzle #327 of the nozzle group 21A and the nozzle #1 of the nozzle group 21B and the distance between the nozzle #327 of the nozzle group 21B and the nozzle #1 of the nozzle group 21C) is 1968·D (note that D=1/360 inches). It should be noted that since printing is performed at 360 dpi, the nozzle pitch is 2·D (k=2). Moreover, the overlap number M=1, the carry amount F=983·D, and $\alpha$=2.

Also in this example, the same effects as those in the embodiments and example described above can be achieved.

===Practical Example 3===

Figure 18:
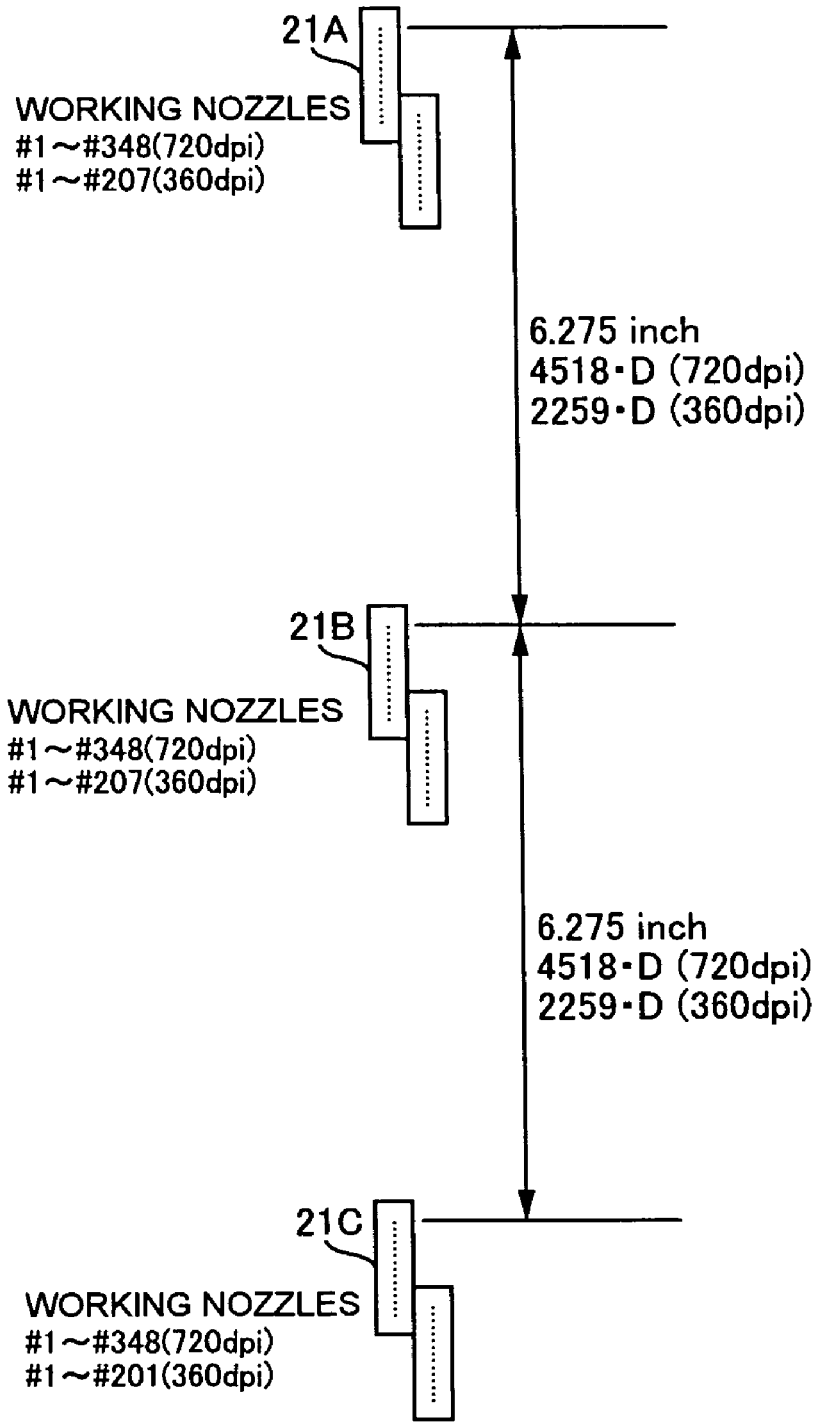
FIG. 18 is a diagram showing a configuration of a head of a third example.

FIG. 18 is an explanatory diagram of a configuration of a head that is used for the third example. It should be noted that the configuration of the nozzle group that is used for this example is the same as the configuration of the nozzle group of Example 2 described above (see FIG. 17A), so that the description thereof is omitted. This example is different from Example 2 described above in the distance between nozzle groups. Regarding the nozzle groups, three nozzle groups are arranged in the carrying direction such that the distance between the nozzles #1 of the nozzle groups is 6.275 inches.

With the above-described head of this example, it is possible to perform "overlap printing at 720 dpi×720 dpi" and "interlaced printing at 360 dpi×360 dpi" (however, this is interlaced printing in which k=2).

When "overlap printing at 720 dpi×720 dpi" is performed, all of the 348 nozzles of each of the nozzle groups serve as the nozzles that are allowed to eject ink. Accordingly, a total of 1042 nozzles serve as the nozzles that are allowed to eject ink. Furthermore, the distance between two adjacent nozzles that are allowed to eject ink and that belong to different nozzle groups (the distance between the nozzle #348 of the nozzle group 21A and the nozzle #1 of the nozzle group 21B and the distance between the nozzle #348 of the nozzle group 21B and the nozzle #1 of the nozzle group 21C) is 3130·D (note that D=1/720 inches). It should be noted that since printing is performed at 720 dpi, the nozzle pitch is 4·D (k=4). Moreover, the overlap number M=2, the carry amount F=521·D, and $\alpha$=6.

When "interlaced printing at 360 dpi×360 dpi" is performed, 207 nozzles, the nozzles #1 to #207, of the 348 nozzles of each of the nozzle group 21A and the nozzle group 21B serve as the nozzles that are allowed to eject ink. Moreover, 201 nozzles, the nozzles #1 to 201, of the 348 nozzles of the nozzle group 21C serve as the nozzles that are allowed to eject ink. Accordingly, a total of 615 nozzles serve as the nozzles that are allowed to eject ink. Furthermore, the distance between two adjacent nozzles that are allowed to eject ink and that belong to different nozzle groups (the distance between the nozzle #207 of the nozzle group 21A and the nozzle #1 of the nozzle group 21B and the distance between the nozzle #207 of the nozzle group 21B and the nozzle #1 of the nozzle group 21C) is 1847·D (note that D=1/360 inches). It should be noted that since printing is performed at 360 dpi, the nozzle pitch is 2·D (k=2). Moreover, the overlap number M=1, the carry amount F=615·D, and $\alpha$=3.

Also in this example, the same effects as those in the embodiments and examples described above can be achieved.

===Practical Example 4===

Figure 19:
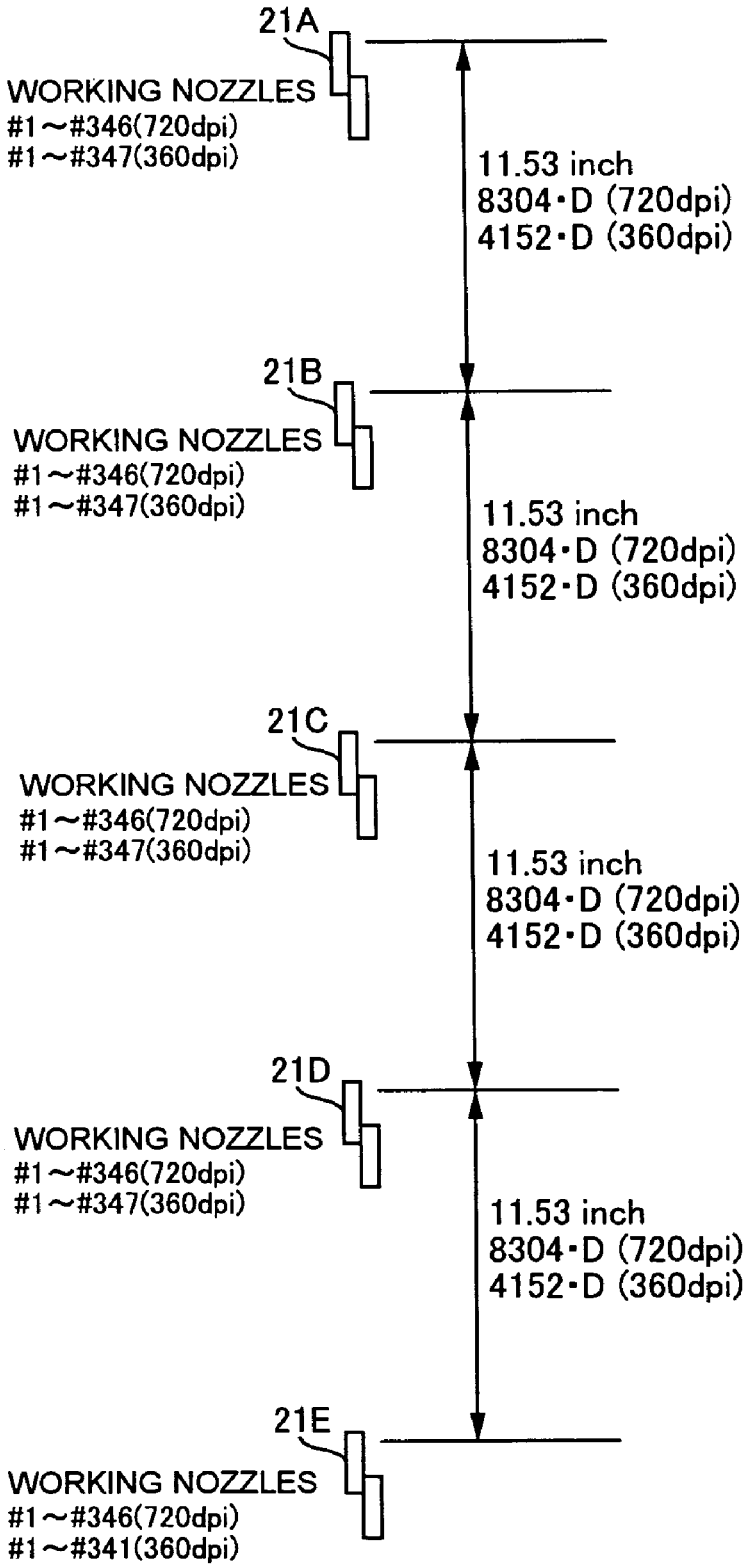
FIG. 19 is a diagram showing a configuration of a head of a fourth example.

FIG. 19 is an explanatory diagram of a configuration of a head that is used for the fourth example. It should be noted that the configuration of the nozzle group that is used for this example is the same as the configuration of the nozzle group of Example 2 described above (see FIG. 17A), so that the description thereof is omitted. This example is different from Example 2 described above in the number of nozzle groups and the distance between the nozzle groups. Regarding the nozzle groups, five nozzle groups are arranged in the carrying direction such that the distance between the nozzles #1 of the nozzle groups is 11.53 inches.

With the above-described head of this example, it is possible to perform "overlap printing at 720 dpi×720 dpi" and "interlaced printing at 360 dpi×360 dpi" (however, this is interlaced printing in which k=2).

When "overlap printing at 720 dpi×720 dpi" is performed, 346 nozzles, the nozzles #1 to #346, of the 348 nozzles of each of the nozzle groups serve as the nozzles that are allowed to eject ink. Accordingly, a total of 1730 nozzles serve as the nozzles that are allowed to eject ink. Furthermore, the distance between two adjacent nozzles that are allowed to eject ink and that belong to different nozzle groups (for example, the distance between the nozzle #346 of the nozzle group 21A and the nozzle #1 of the nozzle group 21B) is 6924·D (note that D=1/720 inches). It should be noted that since printing is performed at 720 dpi, the nozzle pitch is 4·D (k=4). Moreover, the overlap number M=2, the carry amount F=865·D, and $\alpha$=8.

When "interlaced printing at 360 dpi×360 dpi" is performed, 347 nozzles, the nozzles #1 to #347, of the 348 nozzles of each of the nozzle groups 21A to 21D serve as the nozzles that are allowed to eject ink. Moreover, 341 nozzles, the nozzles #1 to 341, of the 348 nozzles of the nozzle group 21E serve as the nozzles that are allowed to eject ink. Accordingly, a total of 1729 nozzles serve as the nozzles that are allowed to eject ink. Furthermore, the distance between two adjacent nozzles that are allowed to eject ink and that belong to different nozzle groups (for example, the distance between the nozzle #347 of the nozzle group 21A and the nozzle #1 of the nozzle group 21B) is 3460·D (note that D=1/360 inches). It should be noted that since printing is performed at 360 dpi, the nozzle pitch is 2·D (k=2). Moreover, the overlap number M=1, the carry amount F=1729·D, and $\alpha$=3.

Also in this example, the same effects as those in the embodiments and examples described above can be achieved.

===Configuration of the Computer System etc. ===

Next, an embodiment of a computer system, a computer program, and a storage medium storing the computer program is described with reference to the drawings.

Figure 20:
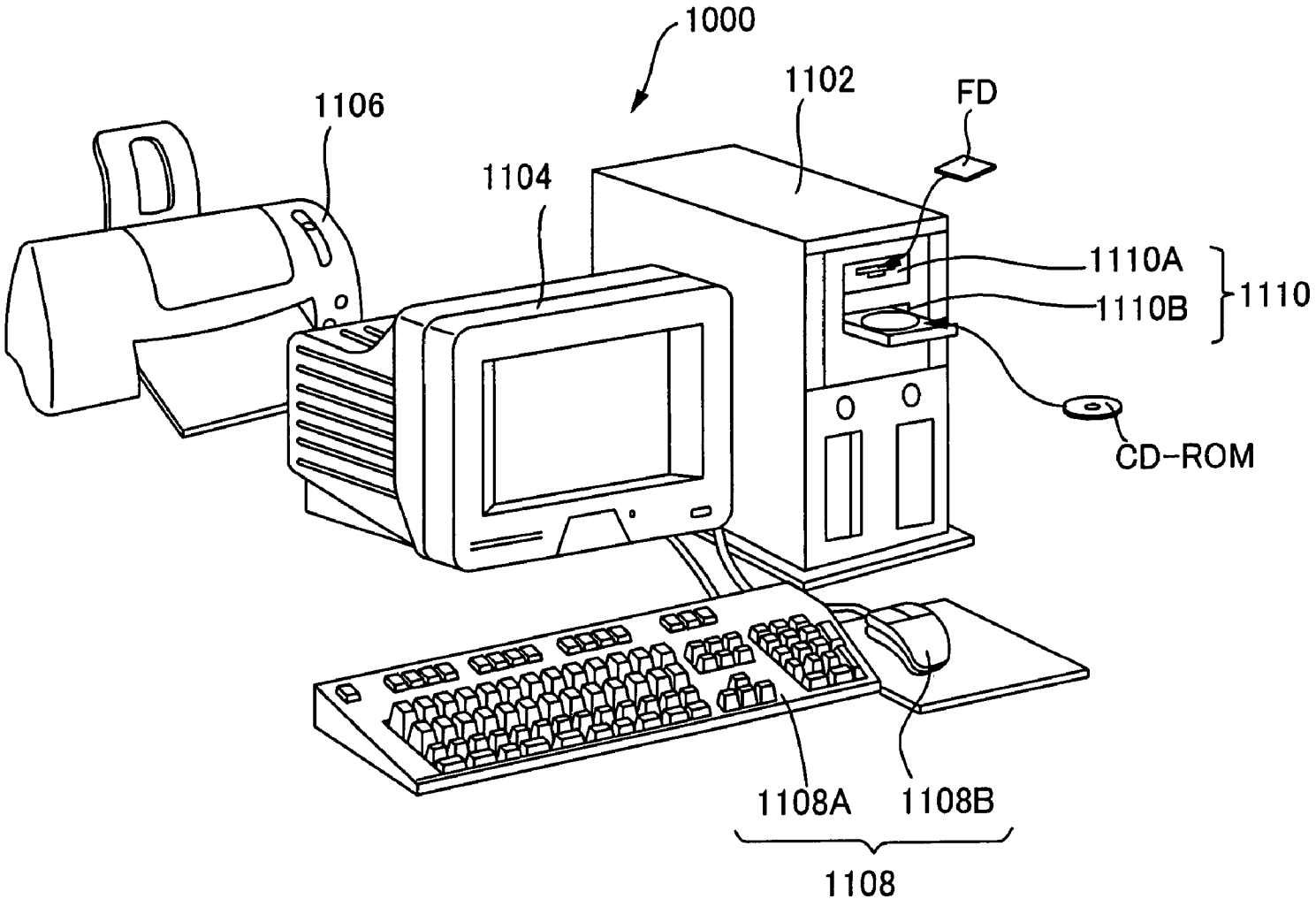
FIG. 20 is an explanatory diagram showing an external configuration of a computer system.

FIG. 20 is an explanatory diagram showing an external configuration of a computer system. A computer system 1000 is provided with a main computer unit 1102, a display device 1104, a printer 1106, an input device 1108, and a reading device 1110. In this embodiment, the main computer unit 1102 is accommodated within a mini-tower type housing. However, this is not a limitation. Generally, a CRT (Cathode Ray Tube), plasma display, or liquid crystal display device, for example, is used as the display device 1104, but there is no limitation to this. The printer 1106 is the printer described above. In this embodiment, the input device 1108 is a keyboard 1108A and a mouse 1108B, but there is no limitation thereto. In this embodiment, a flexible disk drive device 1110A and a CD-ROM drive device 1110B are used as the reading device 1110, but there is no limitation thereto, and the reading device 1110 can also be an MO (Magneto Optical) disk drive device or a DVD (Digital Versatile Disk), for example.

Figure 21:
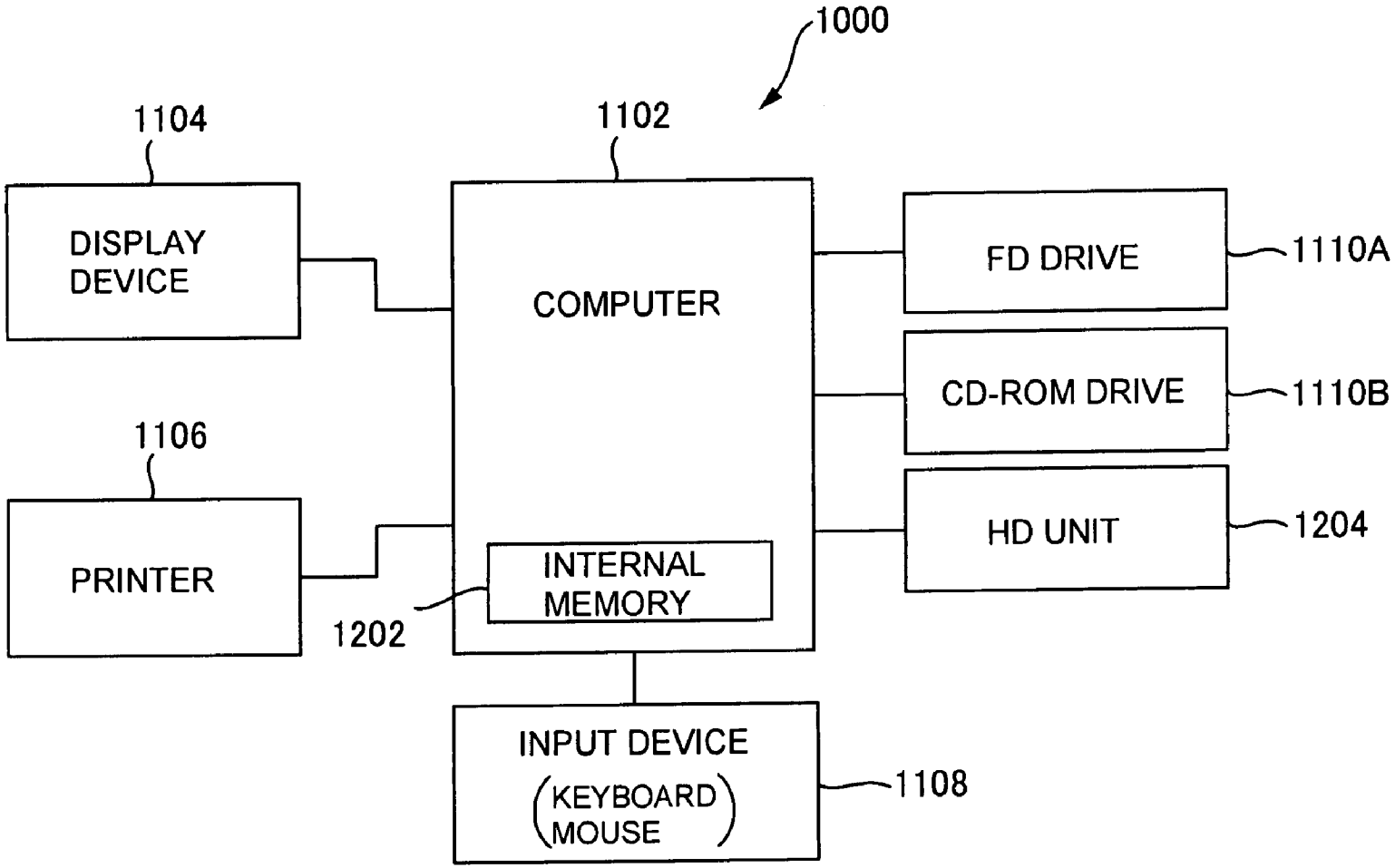
FIG. 21 is a block diagram showing a configuration of the computer system shown in FIG. 11.

FIG. 21 is a block diagram showing a configuration of the computer system shown in FIG. 20. An internal memory 1202, such as a RAM, is provided in the housing accommodating the main computer unit 1102, and also an external memory, such as a hard disk drive unit 1204, is provided.

A computer program for controlling the operation of the above-described printer can be downloaded onto the computer system 1000, for example, connected to the printer 1106 via a communication line, such as the Internet, and it can also be stored on a computer-readable storage medium and distributed, for example. Various types of storage media can be used as this storage medium, including flexible disks FDs, CD-ROMs, DVD-ROMs, magneto optical disks MOs, hard disks, and memories. It should be noted that information stored on such storage media can be read out by various types of reading devices 1110.

Figure 22:
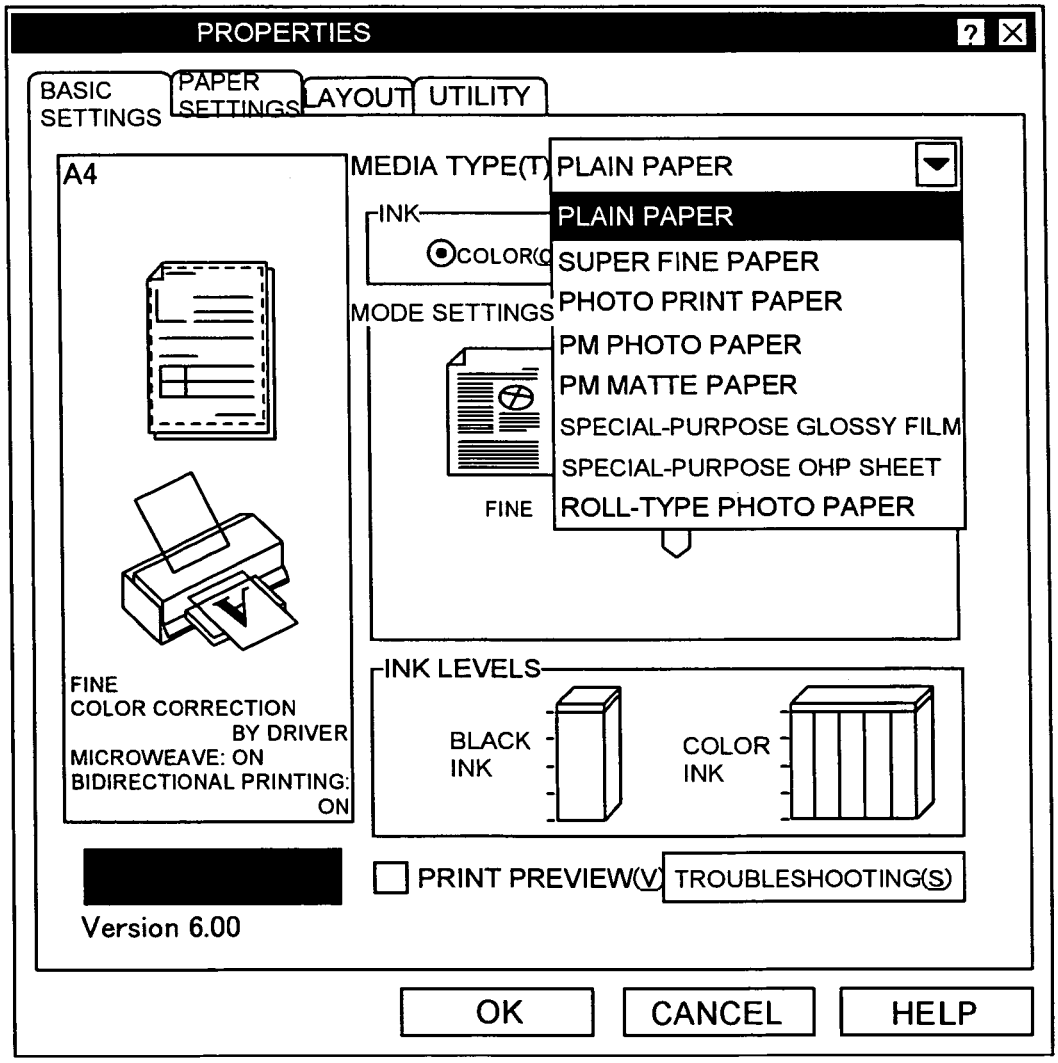
FIG. 22 is an explanatory diagram showing a user interface.

FIG. 22 is an explanatory diagram showing a user interface of a printer driver that is displayed on a screen of the display device 1104 connected to the computer system. A user can use the input device 1108 to make various settings of the printer driver.

The user can select the print mode from this screen. For example, the user can select as the print mode, a quick print mode or a fine print mode. From this screen, the user also can select the dot spacing (resolution) when printing. For example, from this screen, the user can select 720 dpi or 360 dpi as the print resolution.

Figure 23:
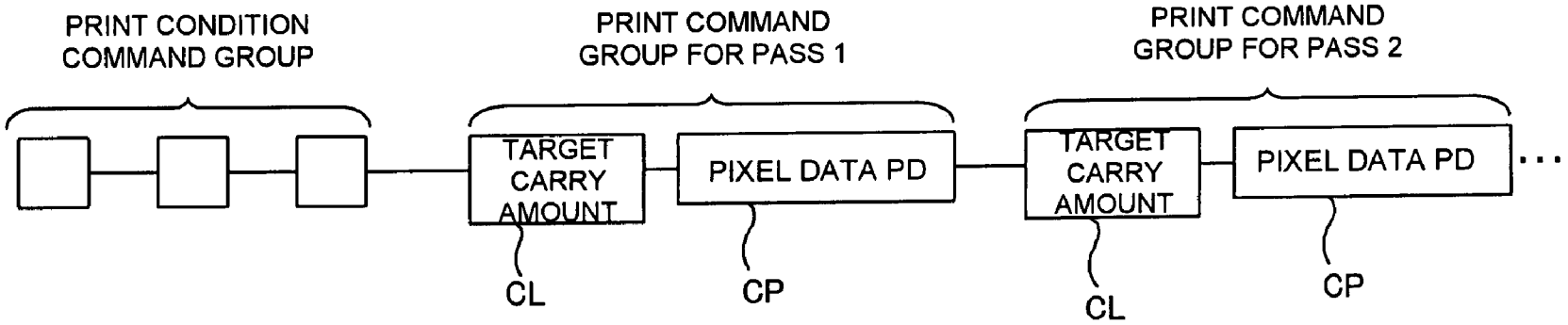
FIG. 23 is an explanatory diagram of a format of print data.

FIG. 23 is an explanatory diagram of a format of print data supplied from the main computer unit 1102 to the printer 1106. The print data is created from image information based on the settings of the printer driver. The print data has a print condition command group and command groups for respective passes. The print condition command group includes a command for indicating the print resolution and a command for indicating the print direction (unidirection/bidirection), for example. The print command groups for respective pass include a target carry amount command CL and a pixel data command CP. The pixel data command CP includes pixel data PD indicating the recording status for each pixel of the dots recorded in that pass. It should be noted that the various commands shown in the diagram each have a header section and a data section; however, they are shown simplified. Moreover, these command groups are supplied intermittently to the printer side from the main computer unit side for each command. However, the print data is not limited to this format.

In the above description, an example was described in which the computer system is constituted by connecting the printer 1106 to the main computer unit 1102, the display device 1104, the input device 1108, and the reading device 1110. However, this is not a limitation. For example, the computer system can be made of the main computer unit 1102 and the printer 1106, or the computer system does not have to be provided with any one of the display device 1104, the input device 1108, and the reading device 1110. It is also possible for the printer 1106 to have some of the functions or mechanisms of the main computer unit 1102, the display device 1104, the input device 1108, and the reading device 1110. For example, the printer 1106 can be configured so as to have an image processing section for carrying out image processing, a display section for carrying out various types of displays, and a recording media attachment/detachment section to and from which recording media storing image data captured by a digital camera or the like are inserted and taken out.

In the embodiment described above, it is also possible for the computer program for controlling the printer to be incorporated in the memory 65, which is a storage medium, of the control unit 60. Also, the control unit 60 can execute the computer program stored in the memory 65 so as to achieve the operations of the printer in the embodiment described above.

As an overall system, the computer system that is thus achieved is superior to conventional systems.

===Other Embodiments===

In the foregoing description, the printer was mainly discussed. However, it goes without saying that the foregoing description also includes the disclosure of printing apparatuses, printing methods, programs, storage media, computer systems, display screens, screen display methods, methods for manufacturing printed material, recording apparatuses, and devices for ejecting liquids, for example.

Moreover, a printer, for example, serving as an example was described. However, the foregoing embodiments are for the purpose of elucidating the present invention and is not to be interpreted as limiting the present invention. The present invention can of course be altered and improved without departing from the gist thereof and includes functional equivalents.

<Regarding the Head>

In the embodiments and examples described above, the number of nozzles was specified. However, the number of nozzles contained in a single nozzle group is not limited to this.

Also, in the embodiments and examples described above, the number of nozzle groups provided in the head was specified. However, the number of nozzle groups provided in the head is not limited to this.

Also, in the embodiments and examples described above, the nozzles that are allowed to eject ink were specified. However, the nozzles that are allowed to eject ink are not limited to this.

Also, in the embodiments and examples described above, the print mode was specified. However, the print mode is not limited to this.

<Regarding the Recording Apparatus>

In the embodiments and examples described above, a printer was described as an example of recording apparatus. However, this is not a limitation. For example, technology like that of the present embodiments can also be adopted for various types of recording apparatuses that use inkjet technology, including color filter manufacturing devices, dyeing devices, fine processing devices, semiconductor manufacturing devices, surface processing devices, three-dimensional shape forming devices, liquid vaporizing devices, organic EL manufacturing devices (in particular, macromolecular EL manufacturing devices), display manufacturing devices, film formation devices, and DNA chip manufacturing devices. Moreover, methods and manufacturing methods of these are also within the scope of application. Even when the present technology is adopted in these fields, the fact that liquid can be directly ejected (written) onto a target object enables achievement of a reduction in material, process steps, and costs compared to conventional cases.

<Regarding the Ink>

Since the embodiments and examples described above were discussed using a printer, a dye ink or a pigment ink was ejected from the nozzles. However, the liquid that is ejected from the nozzles is not limited to such inks. For example, it is also possible to eject from the nozzles a liquid (including water), such as metallic material, organic material (in particular, macromolecular material), magnetic material, conductive material, wiring material, film-formation material, electronic ink, processed liquid, and genetic solutions. If such liquids are directly ejected toward a target object, a reduction in material, process steps, and costs can be achieved.

<Regarding the Nozzles>

In the embodiments and examples described above, ink was ejected using piezoelectric elements. However, the method for ejecting liquid is not limited to this. For example, other methods, such as a method for generating bubbles in the nozzles by heat, can also be employed.

INDUSTRIAL APPLICABILITY

According to the present invention, there is flexibility in setting of the distance between the nozzle groups when a plurality of nozzle groups are provided in the head. Moreover, the same head can be adopted for a plurality of recording modes.

The invention claimed is:

1. A recording apparatus for forming dots on a medium, comprising:

a head having a plurality of nozzle groups, each of said nozzle groups having a plurality of nozzles that are arranged with a predetermined nozzle pitch;

wherein said recording apparatus forms said dots on said medium by repeating alternately an ejection operation in which a liquid is ejected from said nozzles and a carry operation in which the medium is carried using a predetermined carry amount with respect to said head; and wherein a distance between two nozzles that eject the liquid adjacently and that belong to different ones of said nozzle groups is equal to a sum of an integral multiple of said carry amount and said predetermined nozzle pitch.

2. A recording apparatus according to claim 1, wherein there is a nozzle between said two nozzles that does not eject said liquid.

3. A recording apparatus according to claim 1, wherein a nozzle at one end of said plurality of nozzles that are arranged does not eject said liquid.

4. A recording apparatus according to claim 1, wherein said recording apparatus is capable of performing recording using different recording modes.

5. A recording apparatus according to claim 4, wherein the nozzles that eject the liquid differ for different ones of said recording modes.

6. A recording apparatus according to claim 4, wherein a spacing of said dots formed on said medium differs for different ones of said recording modes.

7. A recording apparatus according to claim 6, wherein the distance between said two nozzles is equal to a sum of an even multiple of said carry amount and said nozzle pitch.

8. A recording apparatus according to claim 4, wherein a number of the nozzles that form a single raster line differs for different ones of said recording modes.

9. A recording apparatus according to claim 1, wherein said head comprises three or more of said nozzle groups; and wherein a number of the nozzles that eject said liquid is equal between at least two of said nozzle groups.

10. A recording apparatus according to claim 9, wherein said two nozzle groups are provided adjacent to each other in a direction in which said medium is carried.

11. A recording apparatus according to claim 1, wherein when a spacing of the dots formed on said medium is D, said nozzle pitch is k·D, a number of said nozzles that are allowed to eject said liquid is N, and the carry amount is F, N and k are coprime, and

F=N·D.

12. A recording apparatus according to claim 1, wherein when a single raster line is formed by M nozzles, and when a spacing of the dots formed on said medium is D, said nozzle pitch is k·D, a number of said nozzles that are allowed to eject said liquid is N, and the carry amount is F, N/M is an integer, N/M and k are coprime, and

F=(N/M)·D.

13. A recording apparatus according to claim 12, wherein the distance between said two nozzles is equal to a sum of an integral multiple of a value obtained by multiplying said carry amount by M and said predetermined nozzle pitch.

14. A recording apparatus according to claim 12, wherein the distance between said two nozzles is equal to a sum of an integral multiple of a value obtained by multiplying said carry amount by k nozzle pitch.

15. A recording apparatus for forming dots on a medium, comprising:

a head having a plurality of nozzle groups, each of said nozzle groups having a plurality of nozzles that are arranged with a predetermined nozzle pitch;

wherein said recording apparatus forms said dots on said medium by repeating alternately an ejection operation in which a liquid is ejected from said nozzles and a carry operation in which the medium is carried using a predetermined carry amount with respect to said head;

wherein a distance between two nozzles that eject the liquid adjacently and that belong to different ones of said nozzle groups is equal to a sum of an integral multiple of said carry amount and said predetermined nozzle pitch;

wherein there is a nozzle between said two nozzles that does not eject said liquid;

wherein a nozzle at one end of said plurality of nozzles that are arranged does not eject said liquid;

wherein said recording apparatus is capable of performing recording using different recording modes;

wherein the nozzles that eject the liquid differ for different ones of said recording modes;

wherein a spacing of said dots formed on said medium differs for different ones of said recording modes;

wherein a number of the nozzles that form a single raster line differs for different ones of said recording modes;

wherein the distance between said two nozzles is equal to a sum of an even multiple of said carry amount and said nozzle pitch;

wherein said head comprises three or more of said nozzle groups, and a number of the nozzles that eject said liquid is equal between at least two of said nozzle groups;

wherein said two nozzle groups are provided adjacent to each other in a direction in which said medium is carried;

wherein when a spacing of the dots formed on said medium is D, said nozzle pitch is k·D, a number of said nozzles that are allowed to eject said liquid is N, and the carry amount is F, N and k are coprime, and

F=ND;

wherein when a single raster line is formed by M nozzles,

N/M is an integer,

N/M and k are coprime, and

F=(N/M)·D; and wherein the distance between said two nozzles is equal to a sum of an integral multiple of a value obtained by multiplying said carry amount by k nozzle pitch.

16. A recording method using a head having a plurality of nozzle groups, each of said nozzle groups having a plurality of nozzles that are arranged with a predetermined nozzle pitch, said method comprising:

forming dots on a medium by repeating alternately an ejection operation in which a liquid is ejected from said nozzles and a carry operation in which the medium is carried using a predetermined carry amount with respect to said head; and performing said ejection operation such that a distance between two nozzles that eject the liquid adjacently and that belong to different ones of said nozzle groups is equal to a sum of an integral multiple of said carry amount and said predetermined nozzle pitch.

17. A storage medium for storing a program for controlling a recording apparatus, comprising:

a storage medium for storing said program;

wherein said recording apparatus includes a head having a plurality of nozzle groups;

wherein each of said nozzle groups has a plurality of nozzles that are arranged with a predetermined nozzle pitch; and wherein said program makes said recording apparatus form said dots on a medium by repeating alternately an ejection operation in which a liquid is ejected from said nozzles and a carry operation in which the medium is carried using a predetermined carry amount with respect to said head, and makes said recording apparatus perform said ejection operation such that a distance between two nozzles that eject the liquid adjacently and that belong to different ones of said nozzle groups is equal to a sum of an integral multiple of said carry amount and said predetermined nozzle pitch.

18. A system for forming dots on a medium comprising:

a main computer unit; and a recording apparatus;

wherein said recording apparatus includes:

a head having a plurality of nozzle groups, each of said nozzle groups having a plurality of nozzles that are arranged with a predetermined nozzle pitch, and forms said dots on said medium by repeating alternately an ejection operation in which a liquid is ejected from said nozzles and a carry operation in which the medium is carried using a predetermined carry amount with respect to said head; and wherein a distance between two nozzles that eject the liquid adjacently and that belong to different ones of said nozzle groups is equal to a sum of an integral multiple of said carry amount and said predetermined nozzle pitch.

* * * * *